US006886636B2

(12) United States Patent
Michael et al.

(10) Patent No.: US 6,886,636 B2
(45) Date of Patent: May 3, 2005

(54) DOWNHOLE FLUID DISPOSAL APPARATUS AND METHODS

(75) Inventors: Clarence Michael, Pratt, KS (US); Bruce D. Kelvo, Chase, KS (US)

(73) Assignee: Down Hole Injection, Inc., Houston, TX (US)

( * ) Notice: Subject to any disclaimer, the term of this patent is extended or adjusted under 35 U.S.C. 154(b) by 0 days.

(21) Appl. No.: 10/137,224

(22) Filed: May 2, 2002

(65) Prior Publication Data

US 2002/0179304 A1 Dec. 5, 2002

Related U.S. Application Data

(63) Continuation-in-part of application No. 09/572,920, filed on May 17, 2000, now abandoned.
(60) Provisional application No. 60/134,719, filed on May 18, 1999.

(51) Int. Cl.[7] ..... E21B 43/40
(52) U.S. Cl. ..... 166/313; 166/265; 166/370
(58) Field of Search ..... 166/265, 313, 166/369, 370

(56) References Cited

U.S. PATENT DOCUMENTS

| | | | | |
|---|---|---|---|---|
| 2,281,801 A | * | 5/1942 | Reynolds et al. | 166/306 |
| 3,167,125 A | | 1/1965 | Bryan | |
| 3,282,341 A | | 11/1966 | Hodges | |
| 3,323,361 A | | 6/1967 | Lebourg | |
| 3,333,638 A | | 8/1967 | Bishop | |
| 3,362,477 A | | 1/1968 | Brandt | |
| 3,468,374 A | | 9/1969 | Reeves | |
| 3,627,046 A | | 12/1971 | Miller et al. | |
| 3,887,342 A | | 6/1975 | Brunnelle | |
| 3,955,822 A | | 5/1976 | Irby | |
| 4,273,191 A | | 6/1981 | Hradel | |
| 4,296,810 A | | 10/1981 | Price | |
| 4,345,766 A | | 8/1982 | Turanyi | |
| 4,393,927 A | | 7/1983 | Singer | |
| 4,429,740 A | | 2/1984 | Malinchak | |
| 4,569,396 A | | 2/1986 | Brisco | |
| 4,596,271 A | | 6/1986 | Brundage | |
| 4,766,957 A | * | 8/1988 | McIntyre | 166/265 |
| 4,799,544 A | | 1/1989 | Curlett | |
| 4,805,697 A | | 2/1989 | Fouillout et al. | |
| 4,889,184 A | | 12/1989 | Lugtmeier et al. | |
| 4,905,760 A | | 3/1990 | Gray | |
| 4,917,190 A | | 4/1990 | Coppedge | |
| 4,991,857 A | | 2/1991 | Pippert | |
| 5,137,083 A | | 8/1992 | Bump | |
| 5,176,216 A | * | 1/1993 | Slater et al. | 166/105.5 |
| 5,296,153 A | * | 3/1994 | Peachey | 210/787 |
| 5,425,416 A | | 6/1995 | Hammeke et al. | |
| 5,497,832 A | * | 3/1996 | Stuebinger et al. | 166/369 |
| 5,579,838 A | | 12/1996 | Michael | |
| 5,791,411 A | | 8/1998 | Ricalton et al. | |
| 5,816,326 A | | 10/1998 | Slater | |
| 5,899,270 A | | 5/1999 | Watson | |
| 5,979,559 A | * | 11/1999 | Kennedy | 166/369 |

(Continued)

OTHER PUBLICATIONS

UTEX Industries, Inc., "Installation Instructions for Unitized Packing Cartridge Assembly", 2 pages.

*Primary Examiner*—Hoang Dang
(74) *Attorney, Agent, or Firm*—Jack E. Ebel

(57) ABSTRACT

A seal cartridge and barrel manifold seal are provided for use in a subterranean well and in a method to inject fluid, that is initially produced into the well from a subterranean formation or zone, into another subterranean formation or zone. The seal cartridge has two distinct annular seals positioned within opposite sides of a unitary housing to inhibit fluid flow through the housing in both axial directions along a rod that is positioned through the housing. A barrel seal manifold is provided that is unitary in design and has tapered flow surfaces thereby provided increased strength, flow dynamics and life.

13 Claims, 13 Drawing Sheets

U.S. PATENT DOCUMENTS 6,032,743 A * 3/2000 Bowlin et al. ..... 166/369
6,085,837 A 7/2000 Massinon et al.
6,089,317 A 7/2000 Shaw
6,092,599 A 7/2000 Berry et al.
6,105,670 A 8/2000 Klos et al.
6,116,341 A * 9/2000 Stuebinger et al. ..... 166/265
6,196,312 B1 * 3/2001 Collins et al. ..... 166/265

* cited by examiner

DOWNHOLE FLUID DISPOSAL APPARATUS AND METHODS

REFERENCE TO RELATED PATENT APPLICATION

This application is a continuation-in-part of copending U.S. patent application Ser. No. 09/572,920, filed on May 17, 2000 which claims the benefit of U.S. provisional patent application Ser. No. 60/134,719, filed on May 18, 1999 and now abandoned.

BACKGROUND OF THE INVENTION

1. Field of the Invention

The present invention generally relates to subsurface disposal techniques and, more particularly, is concerned with a downhole stuffing box assembly and pump barrel manifold seal coupling.

2. Description of the Prior Art

Over the past few years methods have been introduced that could allow the production of gas from a productive formation and, simultaneously, the disposal of drainage, such as water, from the productive formation in the same well bore. These methods would virtually eliminate the cost of disposal of co-produced water that is ordinarily pumped to the surface and transported to another disposal well.

To achieve simultaneous disposal of the gas production drainage water, the well must have a lower non-productive water-bearing disposal formation that will accept the drainage water. A pressure greater than the water injection pressure of the disposal formation is required to force the drainage water into the disposal formation. An isolation packer is required between the well tubing and casing to isolate the upper productive formation from the lower non-productive disposal formation.

Currently, there are three types of methods being used to force drainage water into the disposal formation with varying degrees of success. A first type is a gravity method as disclosed in U.S. Pat. No. 5,176,216 to Slater et al. This patent discloses a sucker rod actuated reciprocating insert pump and a by-pass seating nipple at the base of the production tubing string above the isolation packer. The seating nipple has a central passage receiving the pump and is closed at its lower end. The seating nipple has side intake ports communicating with the central passage and the pump and a series of longitudinal by-pass holes drilled through the length of the nipple side wall and circumferentially spaced from the side intake ports. Gas rises in the casing annulus as drainage water separates via the influence of gravity and flows downward in the casing annulus to the side intake ports of the seating nipple. The drainage water is then pumped upwardly through the tubing string in a conventional manner by the insert pump until the static weight of the water column equals the water injection pressure of the disposal formation. Continued upward pumping of additional drainage water causes drainage water from the water column to migrate downward via the influence of gravity through the longitudinal by-pass holes in the seating nipple to below its closed lower end and therefrom to the disposal formation.

In the event that the water injection pressure of the disposal formation is fairly low, the height of the water column in the tubing string may be fairly low. The rod string connected to the pump will then be stroking dry throughout its length from the top of the water column to the well surface. This would cause extreme friction and rod and tubing wear. Furthermore, there would be less downstroke plunger force and the rods could go from neutral to compression as opposed to from tension to compression. This condition has caused rod box connections to loosen and unscrew. On the other hand, in the event the water injection pressure is greater than the total weight of the water column, pressure will be created at the surface polish rod seal. High surface pressure could cause premature packing wear and leakage. When measurable surface pressure is maintained along with low annulus fluid volume or the well is pumped off partially, a high gas-to-water ratio is being pumped. This will create gas pockets in the tubing string and at the surface and cause excessive surface seal packing wear. Severe gas locking may occur in the pump, causing pump damage and poor pump performance.

A second type is a disposal formation injection method as disclosed in U.S. Pat. No. 5,425,416 to Hammeke et al. This patent discloses a downhole or below production disposal (BPD) injection tool connected to a modified insert or tubing pump that has a rod lift supported solid plunger with traveling seals (no traveling valves) that pumps down rather than up. The BPD tool has one-way ball and seat type valves built internally around the outer radius and a back pressure valve (check valve) inside the tool discharge passage at the base. On the upstroke drainage water from the productive formation is drawn into the pump cylinder via the one-way valves, and on the downstroke is discharged downward out through the back pressure valve, through the production isolation packer and into the disposal formation. The tubing above the plunger is loaded full with static water. The weight of the tubing water assists the rod string weight in providing the forces needed for the plunger downstroke to inject the drainage water into the pressurized disposal formation.

The BPD injection method has had problems maintaining a full static tubing load, causing the rod string to "stack out" on the downstroke. Also, if the tubing ID and the sucker rods are not thoroughly clean when the system is installed, trash (scale, etc.) will settle out on top of the plunger. A close fit tolerance of the barrel plunger is required, to prevent fluid slippage. The use of lip type traveling plunger seals soon wear from static tubing fluid trash and extreme friction heat when gassy fluid is pumped. There are other factors that also contribute to accelerated plunger seal wear. A considerable amount of tension must be maintained on the isolation packer to provide the isolation seal and to eliminate tubing movement from the stroking action of the pump. Most well bores are somewhat deviated. As the isolation packer is run below the pump and set in tension, the pump barrel is pulled out of alignment against the tight side of the casing. No top plunger wear bearing or tubing or barrel centralizer is used in this method.

A third type is the progressive cavity pump method which has had problems controlling low pumping rates when the annulus fluid is pumped off. When rate volume cannot be controlled and the fluid is pumped off, rapid heat build up occurs causing premature pump failure. Also, the use of submersible pumps is quite expensive and may be cost prohibitive in some wells.

SUMMARY OF THE INVENTION

The present invention overcomes the aforementioned drawbacks by providing a downhole stuffing box assembly and pump barrel manifold seal coupling that are cost effective and will enhance the aforementioned subsurface disposal technologies. The downhole stuffing box assembly can be used in conjunction with the insert pump barrel manifold seal coupling to greatly enhance the performance of the prior art gravity method by converting an upward discharge insert pump gravity flow to a downward pressure flow so that a full tubing fluid load can be independently maintained above the downhole stuffing box assembly.

Accordingly, the present invention is directed to a seal cartridge for use in inhibiting axial fluid flow along a rod. The seal cartridge comprises: a substantially tubular housing having a first end and a second end; at least one first annular seal positioned within the housing nearest to the first end and having an orientation that is adapted to inhibit fluid from flowing axially from the first to the second end when a rod is positioned through the housing; and at least one second annular seal positioned within the housing nearest to the second end and having an orientation that is adapted to inhibit fluid from flowing axially from the second to the first end when a rod is positioned through the housing. When a rod is positioned therethrough, this seal cartridge forms an embodiment of the downhole stuffing box of the present invention.

In accordance with another embodiment of the present invention, a barrel manifold seal is provided which comprises: a substantially cylindrical, unitary body having a first end portion, an intermediate portion and a second end portion; a substantially axial first bore extending through the first end portion and terminating within the intermediate portion; a substantially axial second bore extending into and terminating within the second end portion; a substantially transverse bore extending through the intermediate portion, the transverse bore being in fluid communication with the first bore; and at least one arcuate slot extending through the first end portion and the intermediate portion. The at least one arcuate slot is in fluid communication with the second bore.

In accordance with a further embodiment of the present invention, an assembly is provided for pumping fluids in a well. The assembly comprises a pump having an elongated moveable rod and a seal cartridge positioned about the elongated moveable rod for inhibiting fluid flow along the rod in either axial direction.

In accordance with a still further embodiment of the present invention, a method for disposing fluid downhole is provided. Fluid is produced from a first subterranean formation into a well that penetrates and is in fluid communication with the first formation. The fluid separates in the well into a first fluid and a second fluid. The second fluid is pumped against a flow barrier in said well by means of a pump having a moveable rod. The flow barrier inhibits flow of the pumped second fluid axially along the rod at a point within the well thereby permitting the pumped second fluid to be injected into a second subterranean formation that the well penetrates and is in fluid communication with. These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
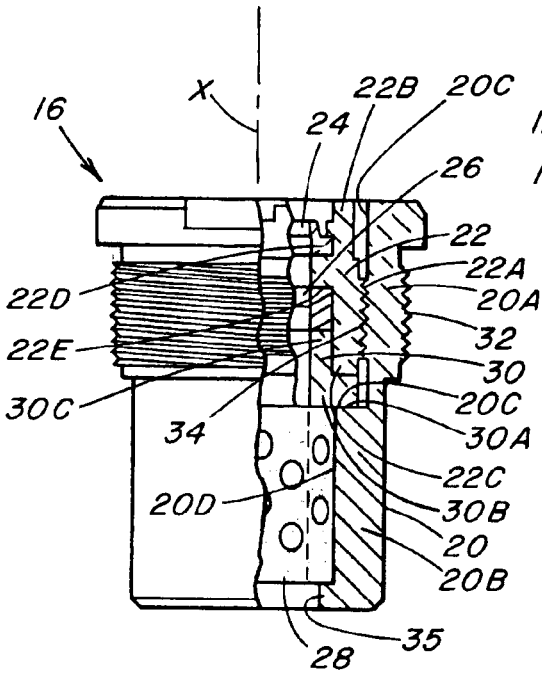
FIG. 2 is a side elevational view of one of a pair of bearing/seal subassemblies of the DSB assembly of FIG. 1.
Figure 1:
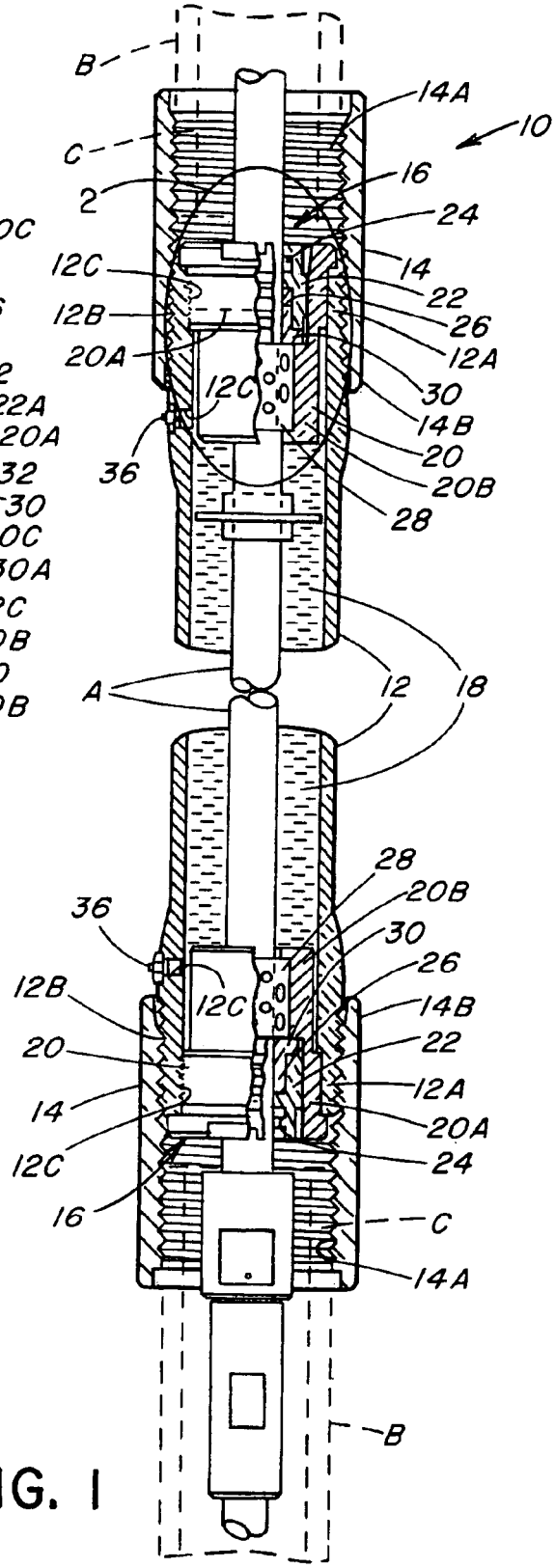
FIG. 1 is a longitudinal sectional view of a first embodiment of the DSB assembly of the present invention shown sealing between upper and lower lengths of a pump pull rod.

Referring to the drawings and particularly to FIGS. 1 and 2, there is illustrated a first embodiment of the DSB assembly of the present invention, generally designated 10. The DSB assembly 10 basically includes an elongated tubular housing 12, a pair of tubular connectors 14, and a pair of annular-shaped bearing/seal subassemblies 16 axially displaced from one another and disposed within the opposite ends 12A of the tubular housing 12 and about an elongated movable rod A, such as a reciprocally movable pump pull rod, running through a tubing string B. Each tubular connector 14 is substantially shorter in axial length than the tubular housing 12. Each tubular connector 14 also is internally threaded at 14A for threadably coupling with external threads 12B on the opposite ends 12A of the tubular housing 12 and for threadably coupling with external threads (not shown) on end sections C of the tubing string B so as to connect the tubular housing 12, in line, in the tubing string B. The bearing/seal subassemblies 16 provide, in combination, bearings and seals at the opposite ends 12A of the tubular housing 12 for the moving pump pull rod A so as to define a lubrication reservoir 18 within the tubular housing 12 between the bearing/seal subassemblies 16. The DSB assembly 10 thus provides a seal means between upper and lower lengths of the movable rod A relative to the DSB assembly 10.

More particularly, each bearing/seal subassembly 16 of the DSB assembly 10 includes an outer housing 20, an inner housing 22, a wiper ring 24, a seal element 26, a bearing element 28, and a bushing 30 between the seal and bearing elements 26, 28. Each of the housings 20, 22, wiper ring 24, seal element 26, bearing element 28 and bushing 30 are annular, and more specifically cylindrical, in shape. The outer housing 20 has first and second portions 20A, 20B tandemly arranged with respect to one another along a longitudinal axis X of the subassembly 16 which respectively concentrically surround and receive the inner housing 22 and the bearing element 28. The first portion 20A of the outer housing 20 is externally threaded at 32 for threadably fitting with internal threads 12C on a respective one of the opposite ends 12A of the tubular housing 12. The first portion 20A of the outer housing 20 is internally threaded at 34 for threadably fitting with external threads 22A on the inner housing 22 intermediate its axially spaced first and second ends 22B, 22C. The second portion 20B of the outer housing 20 has a smaller inside diameter than the first portion 20A thereof so as to define an interior annular shoulder 20C extending radially between interior surfaces 20C, 20D of the respective first and second portions 20A, 20B of the outer housing 20.

The inner housing 22 defines an interior annular groove 22D adjacent its first end 22B which seats the rod wiper ring 24 and defines an interior annular shoulder 22E opposite from its external threads 22A and facing toward and spaced from its second end 22C. Also, the second end 22C of the inner housing 22 is spaced axially from the interior annular shoulder 20C of the outer housing 20 so as to receive and clamp therebetween an external annular flange 30A on a first end 30B of the bushing 30. A second end 30C of the bushing 30, opposite from the first end 30B thereof, is spaced axially from the first end 30B thereof and spaced axially from the interior annular shoulder 22E of the inner housing 22 so as to seat the seal element 26 therebetween at a location spaced from the wiper ring 24.

The outer housing 20 has an internal annular flange 35 protruding radially inwardly from the interior surface 20D of the second portion 20B of the outer housing 20 and axially spaced from the first end 30B of the bushing 30 so as to seat the bearing 28 therebetween and in axially alignment with the seal element 26 and wiper ring 24. Interior surface portions of the wiper ring 24, seal element 26 and bearing 28 engage the exterior surface E of the movable rod A extending through respective central openings 24A, 26A, 28A of the wiper ring 24, seal element 26 and bearing 28.

Further, the tubular housing 12 of the DSB assembly 10 has respective filler/bleed off holes 12D provided near the opposite ends 12A of the tubular housing 12 adjacent to first ends 14B of the respective connector couplings 14. Pressure release plugs 36 are received in the holes 12D. Also, a self-adjusting oil slanger 38 is mounted on the movable rod A to provide a pressurized oil flow to the seals 24 and bearings 26 for upstroke and downstroke movements of the movable rod A.

Figure 3:
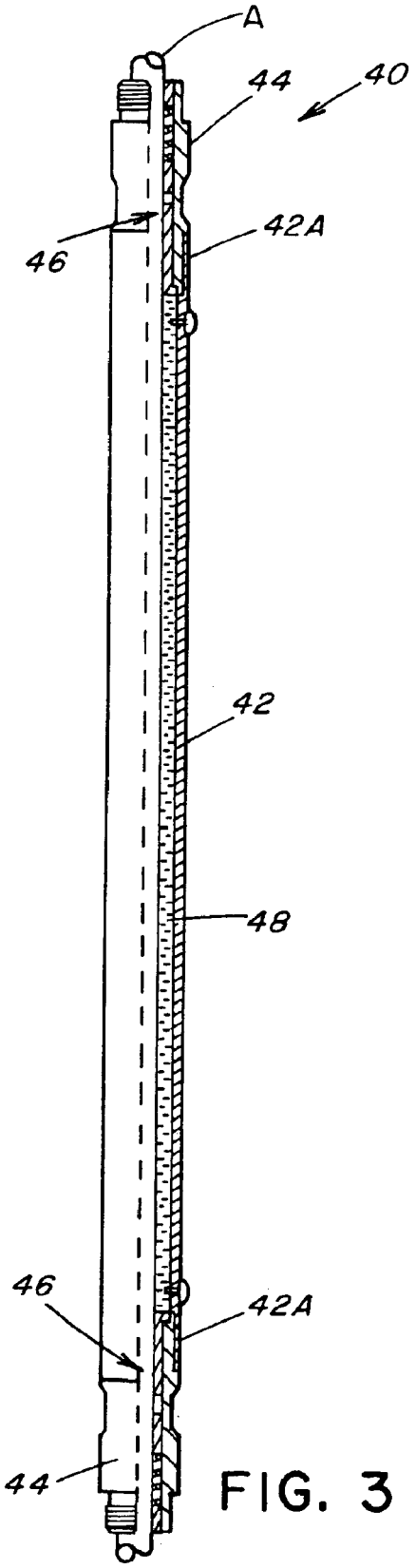
FIG. 3 is a side elevational view of a second embodiment of the DSB assembly of the present invention for use in conjunction with an insert pump.
Figure 4:
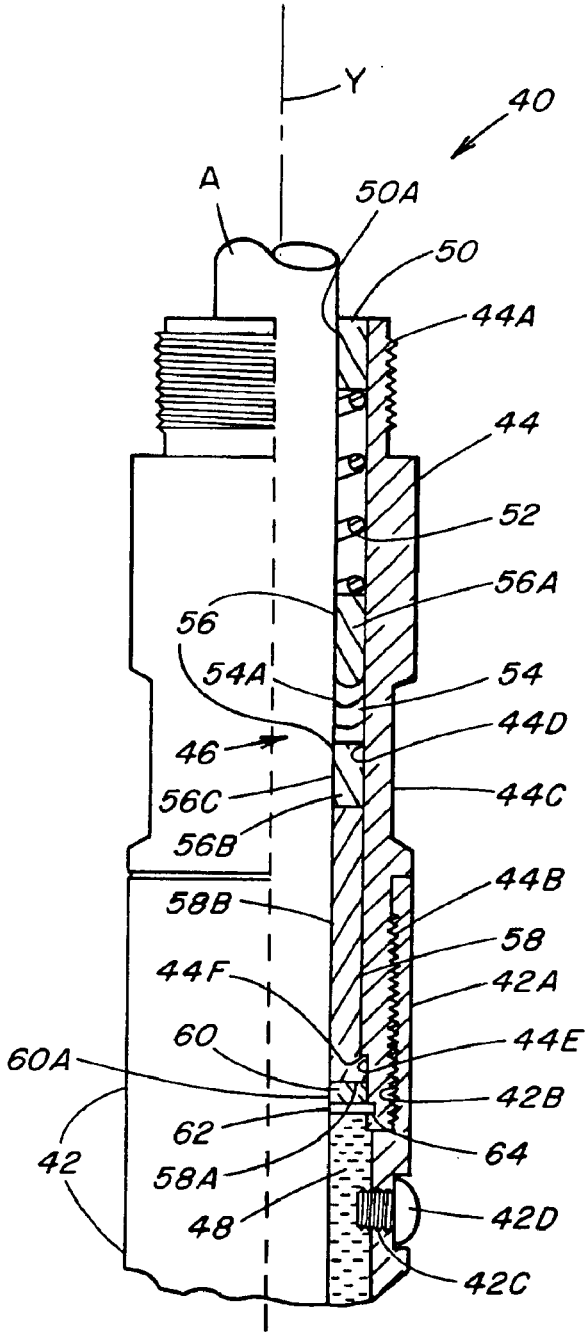
FIG. 4 is an enlarged side elevational view of one of a pair of bearing/seal subassemblies of the DSB assembly of FIG. 3.

Referring to FIGS. 3 and 4, there is illustrated a second embodiment of the DSB assembly of the present invention, generally designated 40. The DSB assembly 40 basically include an elongated tubular housing 42, a pair of tubular connectors 44, and a pair of annular-shaped bearing/seal subassemblies 46 axially displaced from one another and disposed within the opposite ends 42A of the tubular housing 42 and about a movable rod A, such as a reciprocally movable valve rod, running through an insert pump. Each tubular connector 44 is substantially shorter in axial length than the tubular housing 12. Each tubular connector 44 is externally threaded at opposite end portions 44A, 44B for respectively threadably coupling with internal threads 42B on the opposite ends 42A of the tubular housing 42 and with internal threads (not shown) on end sections C of the tubing string B so as to connect the tubular housing 42, in line, in the tubing string B. Also, each tubular connector 44 has opposite external flat regions 44C formed thereon midway between its opposite end portions 44A, 44B for engaging a suitable wrench with the connector 44 to rotate the same. The bearing/seal subassemblies 46 provide, in combination, bearings and seals at the opposite ends 42A of the tubular housing 42 for the movable rod A so as to define an annular lubrication reservoir 48 within the tubular housing 42 about the movable rod A between the bearing/seal subassemblies 46. Further, the tubular housing 42 of the DSB assembly 40 has respective filler/bleed off holes 42C provided near the opposite ends 42A of the tubular housing 42 adjacent to the opposite end portions 44B of the respective connectors 44. Pressure release plugs 42D are received in the holes 42C. The DSB assembly 40 thus provides a seal means between upper and lower lengths of the movable rod A relative to the DSB assembly 40.

More particularly, each bearing/seal subassembly 46 of the DSB assembly 40 includes an end bushing 50, a coil spring 52, a packing seal 54, an adapter element 56, a bearing element 58, and a thrust washer 60. Each of the bushing 50, coil spring 52, packing seal 54, adapter element 56, bearing element 58 and thrust washer 60 are annular, and more specifically cylindrical, in shape. The bushing 50 is tightly fitted within the one end portion 44A of the connector 44 and the thrust washer 60 is fitted within the opposite other end portion 44B of the connector 44 and retained in place by a snap ring 62 that seats in an internal annular groove 64 in the other end portion 44B of the connector 44. The adapter element 56 is slidably disposed within the connector 44 and has separate first and second portions 56A, 56B spaced from one another along a longitudinal axis Y of the subassembly 40. The first and second portions 56A, 56B of the adapter element 56 capture the packing seal 54 therebetween. The coil spring 52 is disposed within and along the one end portion 44A of the connector 44 between the end bushing 50 and the first portion 56A of the adapter element 56 so as to urge the first portion 56A of the adapter element 56 toward the second portion 56B thereof and thereby impose a compressive force that squeezes the packing seal 54 therebetween expanding it radially and augmenting its sealing effect between the exterior surface E of the movable rod A and the interior surface 44D of the connector 44. The bearing element 58 is disposed within and along the other end portion 44B of the connector 44 between the thrust washer 60 and the second portion 56B of the adapter element 56. The connector 44 at its other end portion 44B has an annular region 44E with an enlarged inside diameter so as to define an interior annular shoulder 44F facing toward the thrust washer 60. The bearing element 58 at one end thereof adjacent to the thrust washer 60 has an external annular flange 58A which protrudes beyond the outside diameter of the bearing element 58 and into the enlarged annular region 44E of the connector 44 such that the annular flange 58A is captured between the thrust washer 60 and the interior annular shoulder 44F of the connector 44. Interior surface portions of the end bushing 50, packing seal 54, adapter element 56, bearing element 58 and thrust washer 60 engage the exterior surface E of the movable rod A extending through respective central openings 50A, 54A, 56C, 58B and 60A of the bushing 50, packing seal 54, adapter element 56, bearing 58 and thrust washer 60A.

Figure 5:
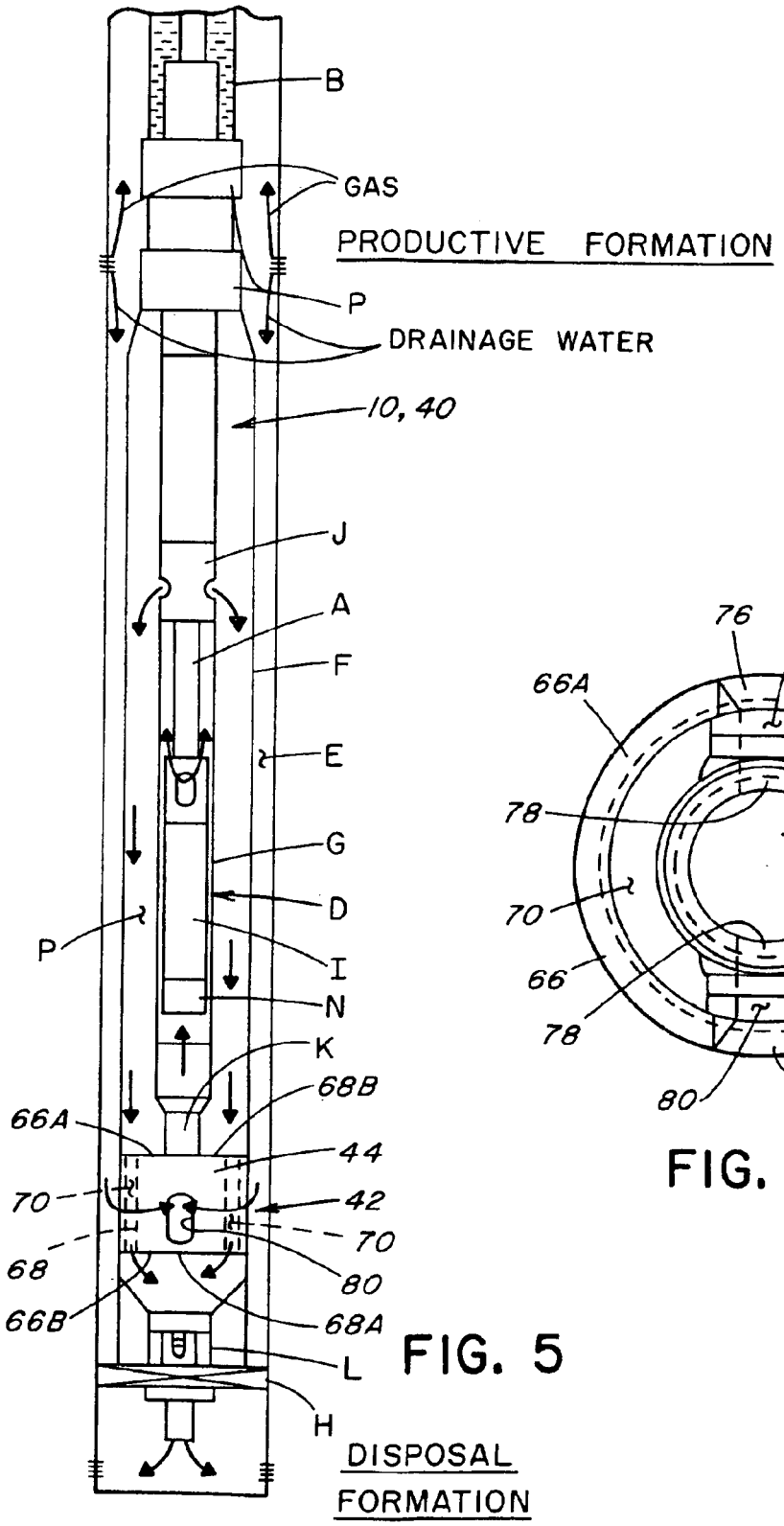
FIG. 5 is a side elevational view of a production string having the DSB assembly of FIG. 3 and one embodiment of a barrel manifold seal of the present invention incorporated in the production string with a sucker rod actuated reciprocating insert pump.
Figure 6:
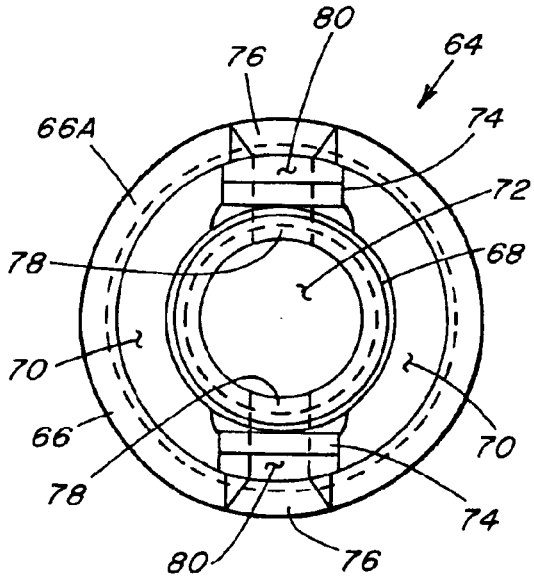
FIG. 6 is an end view of the barrel manifold seal as seen along line 6—6 of FIG. 5.

Referring to FIGS. 5 and 6 of the attached drawings, the DSB assembly 40 may be connected to the top end of an insert pump D in the gravity method of U.S. Pat. No. 5,176,216, and a pump barrel manifold seal (BMS) coupling, generally designated 64, of the present invention can be substituted for a by-pass seal nipple of this patent to thereby convert the upward discharge insert pump gravity flow to an enhanced reverse downward pressurized discharge flow as seen in FIG. 5. A full tubing fluid load can be maintained above the DSB assembly 40 independent of the water injection pressure into the disposal formation.

The BMS coupling 64 includes a pair of outer and inner manifold sleeves 66, 68 concentrically arranged with and radially spaced from one another such that an annular passage 70 is defined between the outer and inner manifold sleeves 66, 68 extending between open upper and lower ends 66A, 66B of the outer manifold sleeve 66. The inner manifold sleeve 68 defines a central opening 72 extending therethrough from a closed lower end 68A to an open upper end 68B of the inner manifold sleeve 68. The inner manifold sleeve 68 is supported within the outer manifold sleeve 66 by a pair of collars 74 extending across the annular passage 70 between opposite internal and external side portions of the outer and inner manifold sleeves 66, 68 so as to interconnect the same. Holes 76, 78 are defined respectively in the outer and inner manifold sleeves 66, 68 at the opposite ends of the collars 74 such that the collars 74 and holes 76, 78 together define a pair of intake openings 80 from the exterior of the BMS coupling 64 to the central opening 72 of the inner manifold sleeve 68 for the inward and upward flow of drainage water from the well casing annulus E. The annular passage 70 through the outer manifold sleeve 66 is a discharge passage 70 for the downward flow of drainage water from within a fluid flow tube housing F. The fluid flow tube housing F extends from a top hold down mandrel and seating nipple P immediately above the DSB assembly 40, downward past and spaced radially outwardly from the DSB assembly 40 and a barrel G of the insert pump D, to the isolation packer H located spaced below the BMS coupling 64.

The insert pump D in the fluid flow tube housing F includes the pump barrel G, a conventional insert pump plunger I disposed in the pump barrel G and supported by the lower end of the movable rod A, an outlet housing J connected between the lower connector 44 of the DSB assembly 40 and the upper end of the pump barrel G, and an API barrel cage bushing K is connected to the lower end of the pump barrel G and is slidably sealed within the inner manifold sleeve 68 of the BMS coupling 46 with a seal ring device. A bottom check valve L is disposed directly below and in flow communication with the discharge passage 70 of the BMS coupling 64.

Drainage water and gas from the production formation M flows into the well casing annulus E where the drainage water separates via the influence of gravity from the gas. The gas flows upward while the drainage water flows downward through the casing annulus E past the fluid flow tube housing F surrounding the DSB assembly 40 and the pump barrel G to and through the intake openings 80 of the BMS coupling 64. The drainage water then flows upward through the central opening 72 of the inner manifold sleeve 68 of the BMS coupling 64 to a standing valve cage N of the insert pump plunger I. Drainage water is drawn into the pump barrel G below the plunger I and forced from the pump barrel G above the plunger I out the outlet housing J into the discharge annulus P between the fluid tube and pump barrel G on the upstroke of the pump plunger I and passes upward through the pump plunger I to thereabove on the pump plunger downstroke. The seal provided by the DSB assembly 40 about the movable rod A diverts the drainage water from the pump barrel G via the outlet housing J, instead of allowing the drainage water to continue up the tubing string B. Further, on each pump plunger upstroke the drainage water in the discharge annulus P and discharge passage 70 of the outer manifold sleeve 66 of the BMS coupling 64 is forced downward through the bottom check valve L and into the disposal formation R as the pressure of the drainage water exceeds the water injection pressure of the disposal formation. The presence of the bottom check valve L allows the water injection pressure to be removed from the pump plunger I during the upstroke, increases pump efficiency and eliminates gas lock.

The sizes of the flow areas of the intake openings 80, central opening 72 and discharge passage 70 of the BMS coupling 64 are greatly increased over the central passage and longitudinal by-pass holes of the replaced seating nipple so as to greatly increased drainage fluid flow, such as from 0.392 to 2.274 A.I. The insert pump gravity method is now converted to a pressure injection method with most, if not all, of the problems associated with the gravity method minimized, if not eliminated.

The DSB assembly 10, 40 may be connected to tubing barrels to function as a plunger seal for the below production disposal (BPD) injection tool of U.S. Pat. No. 5,425,416 in order to retain a required tubing fluid load thereabove.

The advantages of the DSB assembly 10, 40 are as follows: (1) provides a downhole rod/tubing annulus seal for reciprocating rod lift pumps; (2) provides a plunger/pump barrel seal; (3) maintains a full tubing fluid load above the DSB assembly; (4) allows looser plunger/barrel tolerances to minimize friction; (5) minimizes plunger wear or "sticking" from tubing fluid trash; (6) prolongs pump life; (7) can be used in conjunction with conventional pumps; (8) provides for rod or plunger lubrication; (9) provides plunger/rod alignment and wear bearing; (10) minimizes pump failure in deviated wells; (11) increases pump efficiency; (12) can be used in corrosive environments; (13) in conjunction with the BMS coupling converts the gravity method to a pressure system; (14) allows for a wide range of rod and plunger sizes; (15) simple to install; (16) can be used with above production disposal (APD) systems; (17) provides for better downhole monitoring; and (18) minimizes gas locking.

Figure 7:
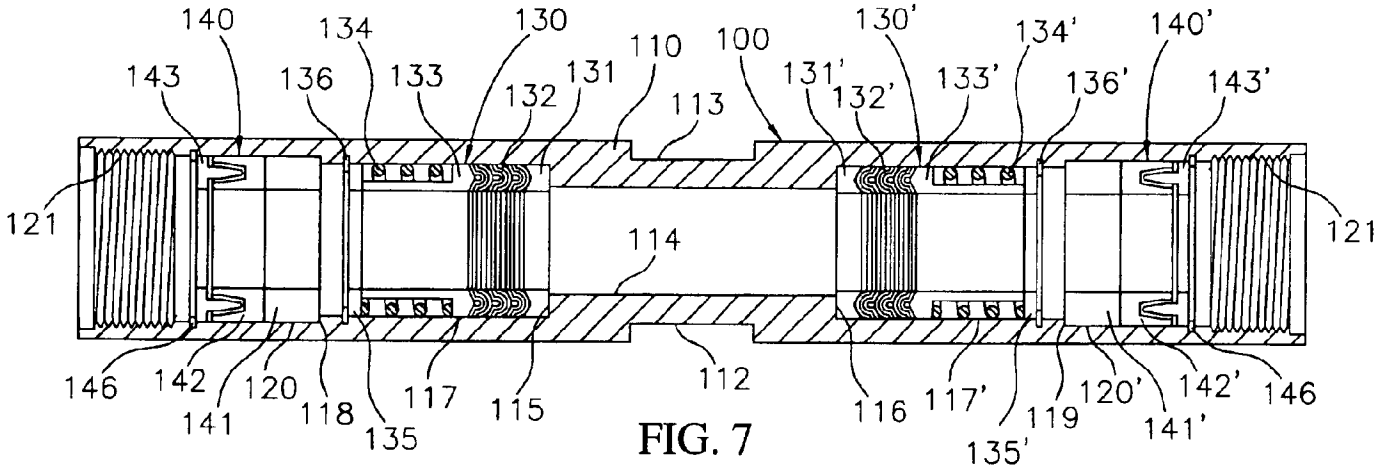
FIG. 7 is a longitudinal, sectional view of a seal cartridge that when positioned around a reciprocating pump rod defines a third embodiment of a downhole stuffing box assembly of the present invention.

An embodiment of a seal cartridge that as positioned within a subterranean well, i.e. downhole, and around an elongated rod defines a downhole stuffing box in accordance with the present invention is illustrated in FIG. 7 generally as 100 and comprises a substantially cylindrical housing 110. This embodiment is designed for use in conjunction with a reciprocating rod pump. The outer surface of the cylindrical housing may provided with generally diametrically opposed, relatively flat surfaces 112, 113 to assist in assembling the seal cartridge 100 to other components in a manner as described below. The inner diameter of housing 100 is provided with a central portion 114 of smaller diameter than intermediate portions 117, 117' thereby defining generally annular shoulders 115, 116 within the interior of housing 100. The inner diameter of housing 100 is also provided with outer portions 120, 120' of greater diameter than the intermediate portions 117, 117' thereby defining generally annular shoulders 118 and 119 within the interior of housing 110. Outer portions 120, 120' are provided with any suitable means, such as screw threads 121, 121', for connection to other components in accordance with the present invention as hereinafter described.

A set of generally annular, primary seal assemblies 130, 130' are disposed on opposite sides of raised central portion 114 so as to abut shoulders 115, 116, respectively. Each primary seal assembly includes a top adapter 131, 131', a set of pressure rings or generally annular seals 132, 132', a spring 134, 134', such as a coil spring, a spring retainer 133, 133' and a bushing 135, 135'. Primary seal assemblies 130, 130' are secured in positioned against shoulders 115, 116 in housing 110 by any suitable means, such as snap rings 136, 136', respectively, which are positioned within grooves in intermediate portions 117, 117'. Each spring 134, 134' functions to keep the set of annular seals 132, 132', respectively, in compression to seal with an elongated rod positioned through housing 110 thereby permitting the seal assembly to be used in conjunction with relatively small pressure differentials across the annular seals in accordance with the present invention. Further, springs 134, 134' function to keep the annular seals 132, 132', respectively, in compression over widely varying pressures encountered during operation in a well. As assembled, each retainer 133 and 133' functions to surround springs 134, 134' in cooperation with housing 110 and bushings 135, 135' and to keep these springs from collapsing during reciprocal movement of an elongated rod that is positioned through the housing as used in accordance with one embodiment of the present invention. The set of annular seals utilized in each seal assembly is illustrated as consisting of three annular seals although the number of annular seals utilized in each seal assembly may vary from one to six or more as will be evident to a skilled artisan depending upon the seal specifications, e.g. pressure ratings, cross sectional area, etc. Each seal ring may be constructed of any suitable material, such as a high temperature resistant nitrile and a strong aramid fabric/modified elastoplast composite jacket available from UTEX Industries Inc. of Houston, Tex. under the mark SuperGold™ 858. A set of generally annular, secondary seal assemblies 140, 140' are disposed on opposite sides of raised central portion 114 so as to abut shoulders 118, 119, respectively. Each secondary seal assembly includes a top adapter 141, 141', a spring energized, elastomeric seal 142, 142', such as is available from UTEX Industries Inc. of Houston, Tex. under the trade name designation AccuSeal, and a T-ring 143, 143'. As assembled T-rings 143, 143' mesh with seals 142, 142', respectively, and the secondary seal assemblies 140, 140' are secured in positioned against shoulders 118, 119 in housing 110 by any suitable means, such as snap rings 146, 146', respectively.

As thus assembled seal cartridge 100 has one primary and one secondary seal assembly positioned on each side of central portion 114 of the inner diameter of housing 100. The annular seals 132 and elastomeric seal 142 on one side of central portion 114 have an orientation that is exactly opposite or reverse of the orientation of annular seals 132' and elastomeric seal 142' on the other side of central portion 114. In this manner and as discussed hereinafter, fluid is inhibited from flowing in either direction along an elongated rod that is inserted within housing 110 and in contact with annular seals 132, 132' and elastomeric seals 142, 142'. Since it is impossible to predict which end of the seal cartridge will be subjected to greater fluid pressure during use and since fluid pressures are constantly changing thereby necessitating that fluid flow be sealed in each axial direction, annular seals 132 and 132' function to seal in both axial directions. This dual acting seal is accomplished in a single seal cartridge.

As positioned around a reciprocating elongated rod 180 (FIG. 8) and positioned in a subterranean well, i.e. downhole, seal cartridge 100 forms another embodiment of the downhole stuffing box of the present invention. As illustrated, seal cartridge is connected to a bearing retainer 150 and a hold down mandrel 170. Bearing retainer 150 has a substantially cylindrical housing 151, the outer surface of which may be provided with generally diametrically opposed, relatively flat surfaces 152, 153 to assist in assembling the bearing retainer 150 to other components useful in the practice of the present invention as described below. The outer surface of one end of housing 151 is provided with any suitable means for attachment to other components, such as screw threads 154. The interior of bearing retainer 150 is provided with varying diameters so as to define generally annular shoulders 156, 157 and 158. A scraper 159 which is constructed to have an generally annular blade 160 abuts shoulder 158 and is secured to housing 151 by any suitable means, such as an interference fit. A generally annular wear ring 162 is positioned within housing 151 so as to abut annular shoulder 157. Wear ring 162 can be constructed of any suitable material, for example a glass, carbon and/or aromatic polyamide fiber, i.e. Kevlar®, filled composite, and is sized so as to provide an extremely close tolerance fit with a reciprocating elongated rod 180 positioned through housing 151 during operation. A generally cylindrical bearing 161 is also positioned within housing 151 so as to abut shoulder 156 and wear ring 162 and can be constructed of any suitable material, for example a fiber reinforced polyetheretherketone. Screw threads 154 are mated with screw threads 121 of housing 110 of seal catridge 100 with seal ring 155 providing a fluid tight seal between these components.

Figure 8:
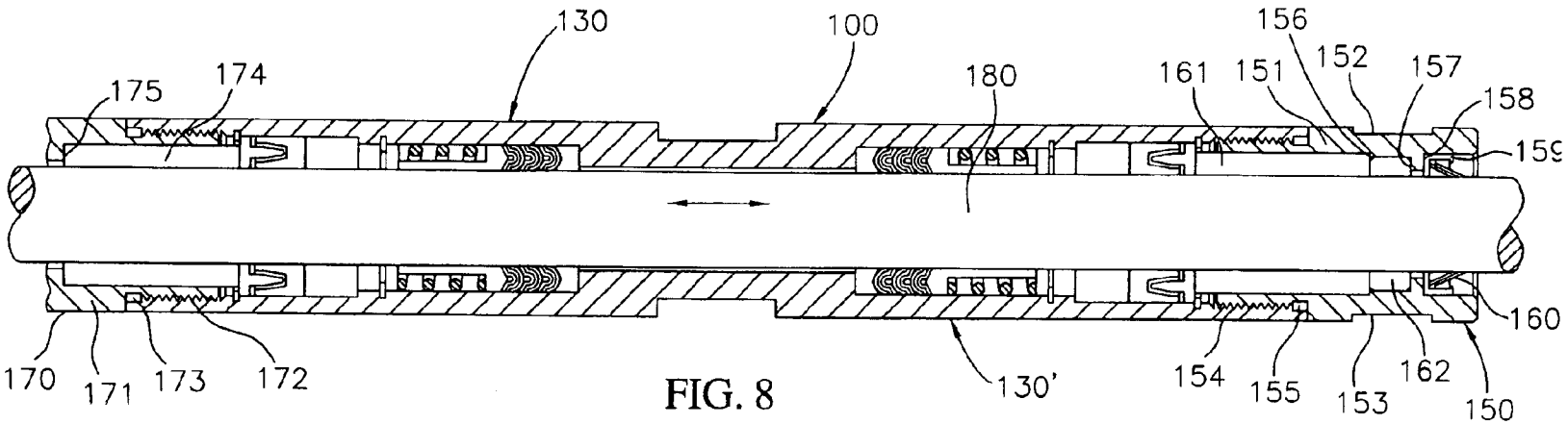
FIG. 8 is a longitudinal, sectional view of the seal cartridge of the present invention illustrated in FIG. 7 as positioned around a reciprocating rod pump to define the third embodiment of the downhole stuffing box assembly and as secured to a clutch and a hold down mandrel.
Figure 9:
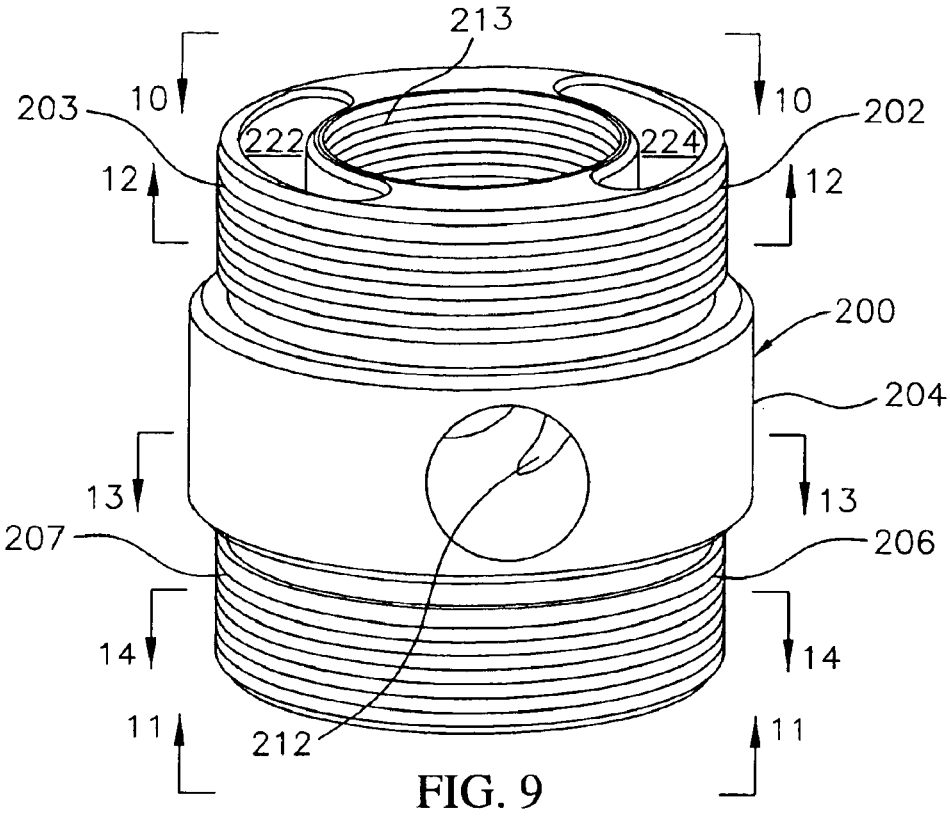
FIG. 9 is a perspective view of another embodiment of a barrel seal manifold of the present invention.

A portion of a hold down mandrel 170 is also illustrated in FIG. 8 and has a generally cylindrical housing 171 having an annular shoulder 175 formed in the interior surface thereof. A generally cylindrical bearing 174 is positioned within housing 171, abuts shoulder 175 and can be made of any suitable material, for example a fiber reinforced polyetheretherketone. The outer surface of one end of housing 171 is provided with any suitable means for attachment to other components, such as screw threads 172. Screw threads 121 on the other end of housing 110 of seal cartridge 100 are mated with screw threads 172 with seal ring 173 forming a fluid tight seal therebetween. Seal cartridge 100, bearing retainer 150 and hold down mandrel 170 define an assembly through which an elongated rod 180 reciprocates during operation in accordance with the methods of the present invention. In operation, seal cartridge 100 functions as a downhole stuffing box to seal reciprocating rod 180. Fluid is prevented from being pumped along rod 180 through mandrel 170 and into seal cartridge 100 by annular seals 132 and also elastomeric seals 142 when utilized. Likewise, fresh, inhibited water is prevented from draining through bearing retainer 150 and into seal cartridge 100 by annular seals 132' and also elastomeric seals 142' when utilized. Thus, seal cartridge 100 prevents fluids that are present on opposite sides thereof from commingling even though such fluids are usually under different pressures. Each set of annular seals 132, 132' of seal assemblies 130, 130' is primarily energized by the pressure of the fluid that is being sealed. However, each primary seal assembly 130, 130' is also energized by springs 134, 134', respectively, which allows the seal cartridge to effectively seal low pressure fluids.

Figure 10:
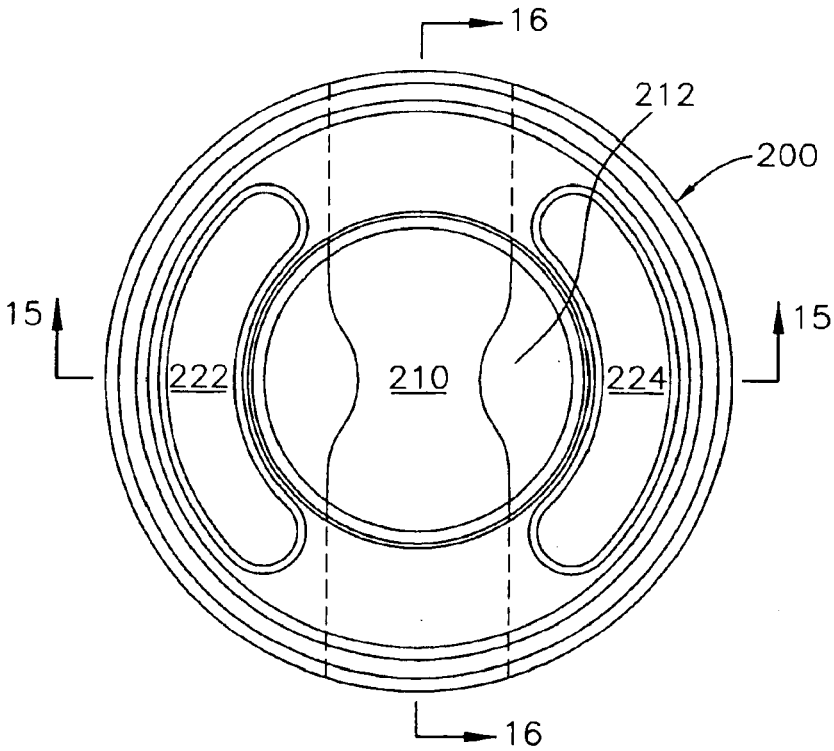
FIG. 10 is a cross sectional view of another embodiment of a barrel seal manifold taken along line 10—10 in FIG. 9.
Figure 11:
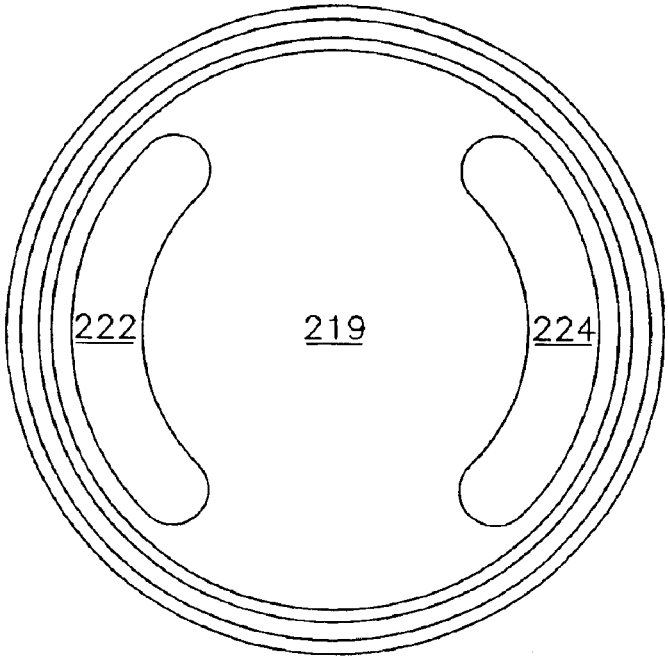
FIG. 11 is a cross sectional view of another embodiment of a barrel seal manifold taken along line 10—10 in FIG. 9.
Figure 12:
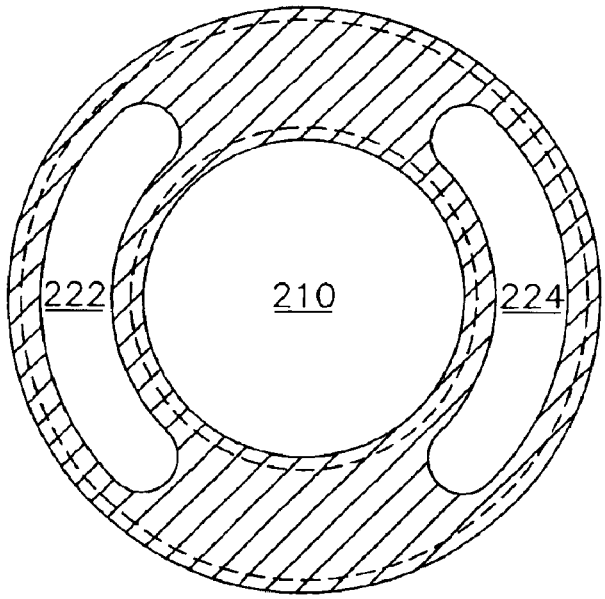
FIG. 12 is a cross sectional view of another embodiment of a barrel seal manifold taken along line 12—12 in FIG. 9.
Figure 13:
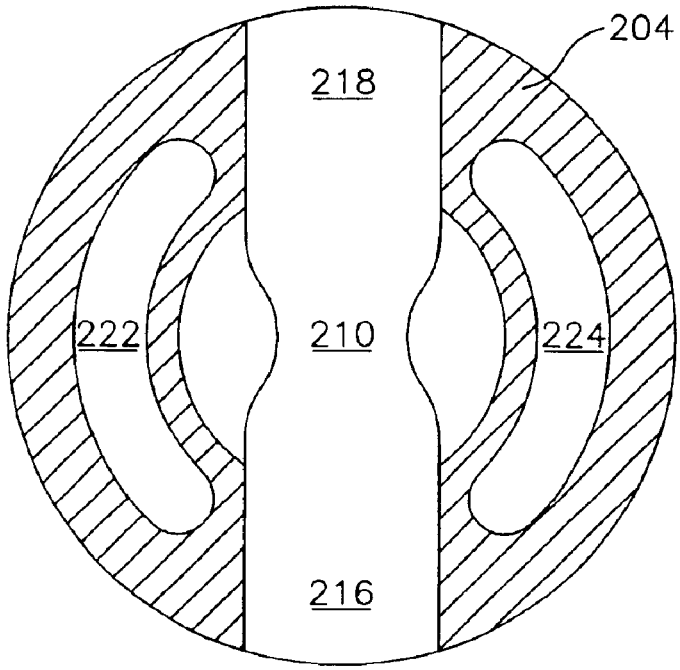
FIG. 13 is a cross sectional view of another embodiment of a barrel seal manifold taken along line 13—13 in FIG. 9.
Figure 14:
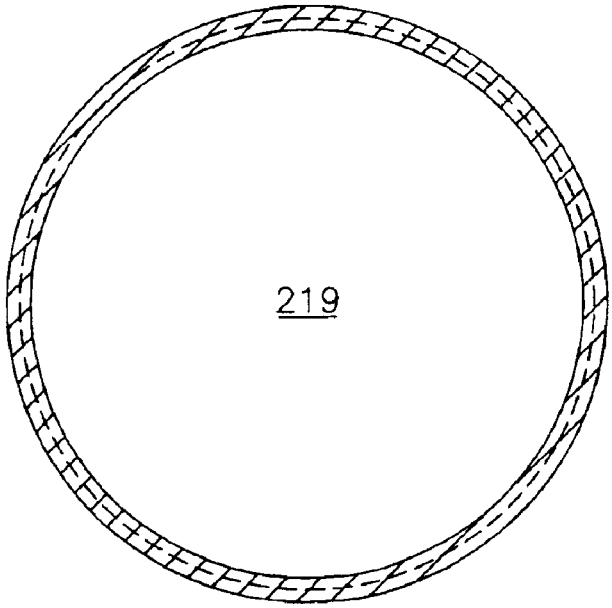
FIG. 14 is a cross sectional view of another embodiment of a barrel seal manifold taken along line 14—14 in FIG. 9.
Figure 15:
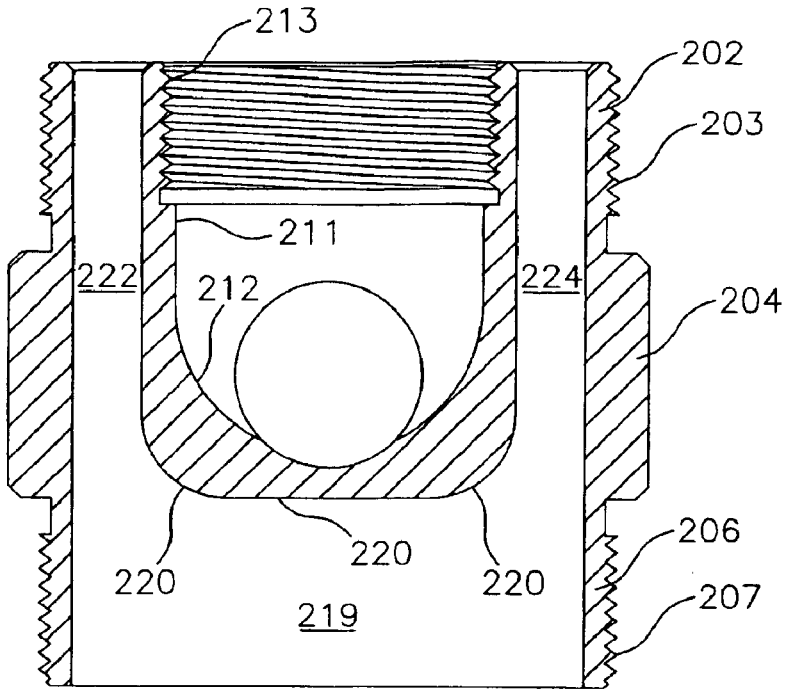
FIG. 15 is a longitudinal, cross sectional view of another embodiment of a barrel seal manifold taken along line 15—15 in FIG. 10.
Figure 16:
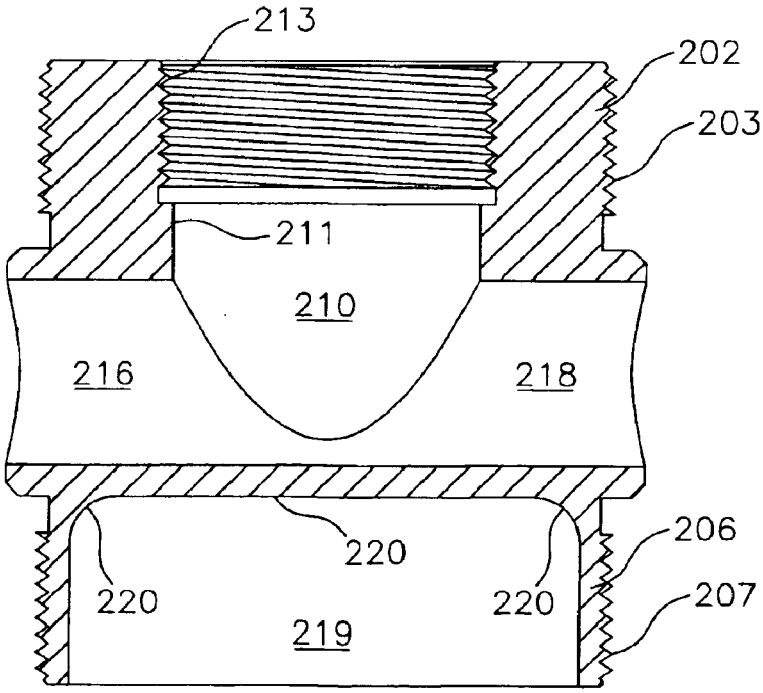
FIG. 16 is a longitudinal, cross sectional view of another embodiment of a barrel seal manifold taken along line 16—16 in FIG. 10.

An embodiment of a barrel manifold seal that can be used in conjunction with the assembly and methods of the present invention is illustrated generally as 200 in FIGS. 9–16. Barrel manifold seal 200 has a generally cylindrical configuration and has a first end portion 202, an intermediate portion 204 and a second end portion 206. The external surface of the first end portion 202 and the second end portion 206 are provided with any suitable means for connection to other apparatus or assemblies, for example screw threads 203 and 207, respectively. A generally cylindrical, axial bore 210 is extends through upper portion 202 and into intermediate portion 204. Bore 210 defines sidewalls 211 in upper portion 202 and intermediate portion 204 of barrel manifold seal 200 and a tapered end walls 212 in intermediate portion 204. Bore 210 may be formed to have any suitable cross sectional configuration, for example an annular configuration. The sidewalls 211 in upper portion 202 are provided with any suitable connection means, such as screw threads 213. A pair of generally diametrically opposed ports 216 and 218 are formed through the wall of intermediate section 204 so as to provide fluid communication between the exterior of barrel manifold seal 200 and axial bore 210. Ports 216 and 218 may be formed to have any suitable cross sectional configuration, for example an annular configuration. Second end portion 206 is provided with a relatively large, axial bore 219 (FIG. 14) having end walls 220 which are tapered. A pair of generally diametrically opposed, arcuate slots are provided in first end portion and intermediate portion 204 of barrel manifold seal 200. Each of these slots is in fluid communication with axial bore 219 in second end portion 206 (FIG. 15) but do not intersect, and therefor are not in fluid communication with, axial bore 210 or ports 216 and 218 (FIGS. 10 and 13).

The barrel manifold seal 200 of the present invention is unitary in construction and is formed by any suitable means, such as by casting. A preferred method of casting is investment casting. In accordance with this method, a sacrificial pattern with the same basic geometrical configuration as described above and illustrated in FIGS. 9–16 is produced by sterolithography as will be evident to a skilled artisan. This sacrificial pattern is usually made by injecting wax into a metal wax injection die, for example an aluminum die. Once a sacrificial wax pattern is produced, it is assembled with other wax components, i.e. runners and pouring cup, to form a metal delivery system, termed a cluster or tree. The cluster is then rinsed in a pattern wash/etching solution to remove any mold release residue from the pattern. The cluster is dipped into a primary slurry/binder and manipulated to receive a complete and even coat of binder. The cluster is then stuccoed with a primary refractory grain and allowed to dry. The dipping and stuccoing process is repeated until a shell of appropriate thickness is applied. Upon drying, coated cluster is placed in a high temperature furnace or steam autoclave which melts out the wax runners, pouring cup and sacrificial pattern thereby forming a ceramic shell containing cavities of the desired casting shape with fluid passageways for transporting molten metal to the cavities. After heating or autoclaving, the remaining amount of wax and any moisture is burned out of the ceramic shell in a furnace. The ceramic shell or mold is then preheated to a specific temperature and filled with molten metal, creating the metal. After the poured metal has sufficiently cooled, the shell or mold is removed from the casting using any suitable method, such as high pressure water, vibratory or shot blast methods. Next, the individual castings are removed from the cluster and gates are removed by any suitable means, such as by grinding. Any final processing, for example sandblasting, machining, etc., is done to finish the casting.

In this manner, barrel manifold seal 200 is manufactured with a unitary construction that eliminates any welds or connections between component parts thereby increasing strength of the barrel manifold seal and reducing stress failure and attendant corrosion. By molding, it is possible to form the barrel manifold seal of the present invention from alloys, such as 17 4 PH stainless steel, that would be impractical to machine and impossible to machine the contoured surfaces of the barrel manifold seal. Further, casting permits the barrel manifold seal to be formed with contoured surfaces, such as portions of end walls 212 of bore 210 and 220 of bore 219, which improve the strength of the barrel manifold seal while providing superior flow dynamics of fluid passing through the barrel manifold seal during operation in accordance with the present invention. This translates into increased life of the barrel manifold seal. Casting allows larger flow passages, i.e. bores 210 and 219, ports 216 and 218 and slots 222 and 224, to be formed which results in a more compact and lighter barrel manifold seal.

Figure 17:
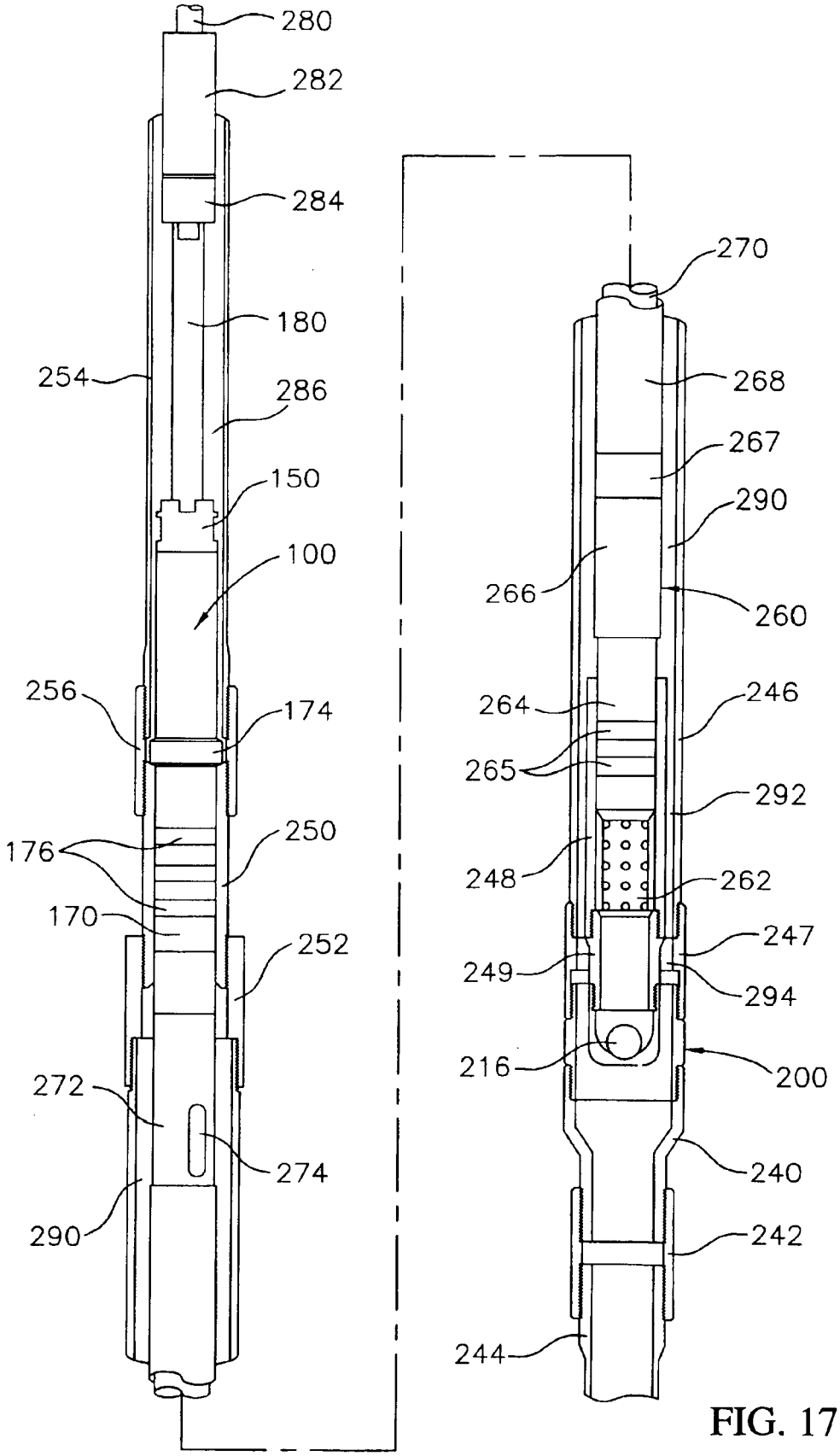
FIG. 17 is a cutaway, partially cross sectioned view of the embodiment of the seal cartridge illustrated in FIG. 7 and of the embodiment of the barrel seal manifold illustrated in FIG. 9 as assembled with a reciprocating insert pump.

Referring to FIG. 17, the seal cartridge 100 and barrel manifold seal 200 are illustrated as assembled to other component parts, including a reciprocating insert pump, for use in accordance with the methods of the present invention. Second end portion 206 of barrel manifold seal is secured to a swedge 240 by means of screw threads 207. Swedge 240 is in turn secured to tubing or tubing sub 244 by any suitable means, such as by a threaded coupling 242. A generally tubular outer barrel 246 has one end thereof secured to the first end portion 202 of barrel manifold seal 200 by any suitable means, such as a threaded coupling 247. The other end of outer barrel 246 is secured to one end of a generally tubular seating nipple 250 by any suitable means, such as a threaded connector 252. The other end of seating nipple 250 is secured to tubing string 254 by any suitable means, such as by a threaded connector 256. Tubing string 254 may be constructed of joints of tubing that are secured together, for example by screw threads, and extend to a well head (not illustrated) at the surface of the earth or sea floor as will be evident to a skilled artisan. A generally tubular seal housing 248 is sized and configured to be positioned within outer barrel 246 and has one end thereof secured to bore 210, such as by screw threads mated with screw threads 213 in bore 210 of the barrel manifold seal. A generally annular fluid passageway 292 is defined between seal housing 248 and outer barrel 246, as is a generally annular fluid passageway 294 defined between coupling 247 and connector 249. As thus assembled, these component parts defined a housing into which a conventional insert pump 260 can be positioned.

Pump 260 comprises a screen or perforated strainer 262, a seal mandrel 264, a standing valve 266, a connector 267, a pump barrel 268, a pump plunger assembly 270, a discharge housing 272 having at least one discharge opening 274, a hold down mandrel 170 and an elongated rod 180. Hold down mandrel is provided with a no-go ring 174 on the outer surface thereof. These component parts are secured together as illustrated and as will be evident to a skilled artisan. Further, the hold down mandrel 170 is secured to seal cartridge 100 which in turn is secured to bearing retainer 150 as described above and illustrated in FIG. 8. Reciprocating rod 180 is positioned through seal cartridge 100 and is secured to plunger assembly 270 by any suitable means, such as screw threads. The other end of the reciprocating rod 180 is secured to a conventional sucker rod string 280 by means of a sucker rod coupling 282 and valve rod bushing connector 284 as illustrated in FIG. 17 and evident to a skilled artisan. During installation, pump 260 is inserted within seal housing 248 such that seals 265, such as hold down cups, on seal mandrel 264 sealingly engage seal housing 248 and seals 176 on hold down mandrel 170 sealingly engage seating nipple 250. Seal nipple 248 and seal mandrel 264 are sized to provide an interference fit as assembled within seal housing 248 and seating nipple 250, respectively, so as to prevent movement of the pump 260, hold down mandrel 170 and seal cartridge 100 upon reciprocation of rod 180 during operation. Pump insertion within seal housing 248 is limited by contact of no-go ring 174 with one end of seating nipple 250.

As thus assembled, an annular passage 290 is defined between pump 260 and outer barrel 246. Passageways 290, 292 and 294 cooperate with slots 222, 224 of the barrel manifold seal to form a fluid tight passageway to convey fluids discharged by operation of the pump 260 through opening 274 in discharge housing 272 through swedge 240 and tubing 244 in a manner as hereinafter described.

Figure 18:
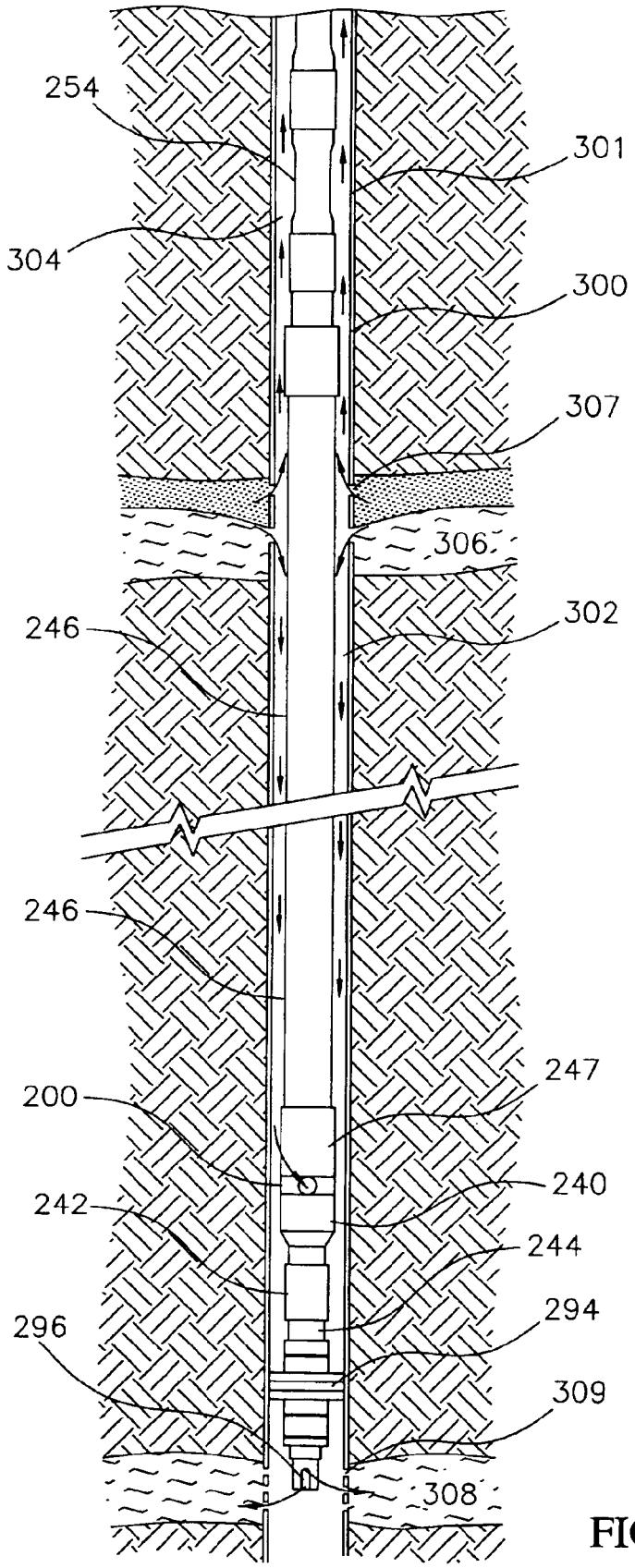
FIG. 18 is partially sectioned view of the assembly of the present invention illustrated in FIG. 17 as positioned in a subterranean well bore for operation in accordance with the methods of the present invention.

As illustrated in FIG. 18, the assembly of the present invention is positioned within a subterranean well 300 which penetrates and is in fluid communication with a producing formation or zone 306 and a disposal formation or zone 308. Disposal formation 308 is at a greater depth from the surface of the earth than producing formation 306. Well 300 is illustrated as being provided with casing 301 which is cemented therein in a manner as will be evident to a skilled artisan to prevent flow of fluid between the casing 301 and the walls of well 300. Well 300 can be substantially vertical, deviated or horizontal. The casing is provided with perforations 307 and 309 to provide for fluid communication with formations 306 and 308, respectively. The assembly is provided with an isolation packer 294 which is secured to tubing 244 intermediate the length thereof and a back pressure or check valve 296 which is secured near the terminal end of tubing 244. Tubing string 254 and the components secured thereto are first positioned within well 300 such that check valve 296 is proximate to formation 308. Once positioned, packer 294 is expanded into sealing engagement with casing 301. Alternatively, packer 294 may already be present in an expanded state in casing 301 with a back pressure or check valve 296 attached to and depending therefrom. In this instance, a tubing on/off tool (not illustrated) is utilized to lock the assembly of the present invention to packer 264. Further, well 300 may be an open hole, i.e. totally or partially without casing, in which case packer 294 is an open hole packer.

Thereafter, sucker rod string 280 and the assembly secured thereto, i.e. reciprocating pump 260, hold down mandrel 170, seal cartridge 100 and bearing retainer 150, are lowered through tubing string 254 until seal mandrel 264 is stabbed into seal housing 248, hold down mandrel 170 is stabbed into seating nipple 250, and no-go ring 174 contacts one end of seating nipple 250. Fluid(s) produced from producing formation 306 enters well 300 via perforations 307 where a reduction in pressure causes gas to separate from produced fluid(s) and be produced upwardly in annulus 304 formed between casing 300 and the assembly of the present invention and tubing 254 to the surface of the earth for transportation, processing and/or use. Separated fluids, e.g. water, and any other liquid that is produced from formation 306 which may include small quantities of gas, flows downwardly in annulus 304 by gravitational force, is prevented from flowing below expanded packer 294 and flows into ports 216 and 218 of barrel manifold seal 200. The hydrostatic head of the column of produced fluid(s) within annulus 304 causes fluid entering the barrel manifold seal to flow upwardly through bore 210, coupling 247 and seal housing 248 and enter screen 262 of pump assembly 260. Fluid is drawn into pump barrel 268 below the plunger assembly 270 and is discharge from the pump barrel on the upstroke of the pump plunger assembly 270. Annular seals 132 in seal cartridge 100 prevent fluid discharged from the pump barrel on the upstroke of the pump plunger assembly from being transported along reciprocating rod 180 and instead functions to divert the fluid into annulus 290 via discharge opening(s) 274 in discharge housing 272. One each downstroke of the pump plunger assembly, fluid is forced through annulus 290, 292, 294, slots 222 and 224 of barrel manifold seal 200, swedge 240, tubing 244 and check valve 296 into disposal formation 308 via perforations 309. The downhole seal provided by annular seals 132 permits fluid to be diverted downhole instead of by a surface stuffing box thereby effectively eliminating the risk of a surface spill of produced fluid and increasing the life of the surface stuffing box that is conventionally utilized with rod pumps. Producing formation 306 and disposal formation 308 may be producing intervals, strata, layers or zones of the same formation that are separated by impervious intervals, strata, layers or zones, for example shale, or may be separate and distinct formations. Producing formation 306 and disposal formation 308 can be in relatively close proximity to each other or may be separated by up to thousands of feet.

During operation, fluid, for example fresh water, may be placed within the annulus 286 between tubing 254 and reciprocating rod 280 and seal cartridge 100 to cool rod 280 during operation, prevent rod couplings from rubbing on the tubing, dampen the rods during reciprocation and to reduce peak torque load on the pump assembly. Further, a corrosion inhibitor may be added to the water to increase the life of the tubing and reciprocating sucker rods. Annular seals 132' in seal cartridge 100 prevent this fresh, inhibited water from migrating along reciprocating rod 180 and commingling with produced fluid that is produced from formation 306 and is present in discharge housing 272. Preferably, annulus 286 is substantially filled with fluid from annular seals 132' to the well head.

Although the embodiment of the present invention that is illustrated in FIG. 17 has been described as being assembled using an insert pump 260, it will be evident to a skilled artisan that pump 260 can be fixedly secured within outer barrel 246 such as by screwing seal mandrel 264 to seal housing 248 and hold down mandrel 170 to seating nipple 250. In this instance, the pump 260, mandrel 170, seal cartridge 200, rod 180 and connector 284 are lowered into the well with tubing string 254. Connector 284 is provided with a mating half of a conventional rod on/off tool. Sucker rod coupling 282 on rod string 280 is provided with the other mating half of a conventional rod on/off tool. Rod string 280 is thereafter lowered through tubing string 254 until the on/off mating half on sucker rod coupling 282 engages the other on/off mating half on connector 284. Thereafter, operation of the assembly is carried out as described immediately above.

Figure 19:
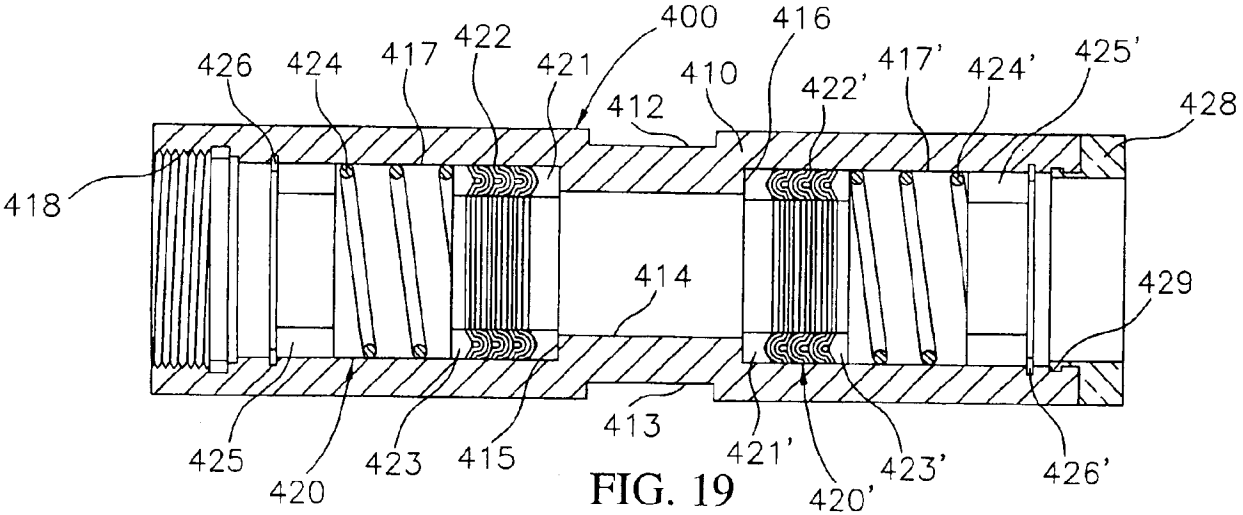
FIG. 19 is a longitudinal, sectional view of a seal cartridge that when positioned around a rotary pump rod defines a fourth embodiment of a downhole stuffing box assembly of the present invention.

Another embodiment of a seal cartridge for use in conjunction with a rotary rod pump, such as a progressive cavity pump, is illustrated generally in FIG. 19 as 400 and comprises a substantially cylindrical housing 410. The outer surface of the cylindrical housing may provided with generally diametrically opposed, relatively flat surfaces 412, 413 to assist in assembling the seal cartridge 400 to other components in a manner as described below. The inner diameter of housing 400 is provided with a central portion 414 of smaller diameter than outer portions 417, 417' thereby defining generally annular shoulders 415, 416 within the interior of housing 400. Outer portions 417, 417' are provided with any suitable means, such as screw threads 418, 418' for connection to other components in accordance with the present invention as hereinafter described.

A set of generally annular, primary seal assemblies 420, 420' are disposed on opposite sides of raised central portion 414 so as to abut shoulders 415, 416, respectively. Each primary seal assembly includes a top adapter 421, 421', a set of annular seals or pressure rings 422, 422', a spring 424, 424', such as a coil spring, a seal adapter 423, 423' and a bearing 425, 425'. Primary seal assemblies 420, 420' are secured in positioned against shoulders 415, 416 in housing 410 by any suitable means, such as snap rings 426, 426', respectively. Each spring 424, 424' functions to keep the set of annular seals 422, 422', respectively, in compression to seal with a rotary rod positioned through housing 410 thereby permitting the seal assembly to be used in conjunction with relatively small pressures in accordance with the present invention. As will be evident to a skilled artisan, springs 424, 424' function to keep the annular seals 422, 422', respectively, in compression over widely varying pressures encountered during operation in a well. As assembled, each adapter 423 and 423' cooperates with springs 424, 424' to uniformly compress seals 422, 422', respectively. The set of annular seals utilized in each seal assembly is illustrated as consisting of three annular seals although the number of rings utilized in each seal assembly may vary from one to six or more as will be evident to a skilled artisan depending upon the seal specifications, e.g. pressure ratings, cross sectional area, etc. Each seal ring may be constructed of any suitable material, such as A high temperature resistant nitrile and a strong aramid fabric/modified elastoplast composite jacket available from UTEX Industries Inc. of Houston, Tex. under the mark SuperGold™ 858.

One end of housing 410 is provided with a generally cylindrical bearing 428 which has an integral snap ring 429 as constructed to secure bearing to housing 410. The outer face of bearing 428 functions to prevent a rod coupling from rotating on this end of housing 410 when a rotary rod is positioned through housing 410 during operation in accordance with the present invention. Annular seals 422 and 422' of seal cartridge 400 have an orientation that is inverted or opposite to each other for reasons hereinafter discussed.

Figure 20:
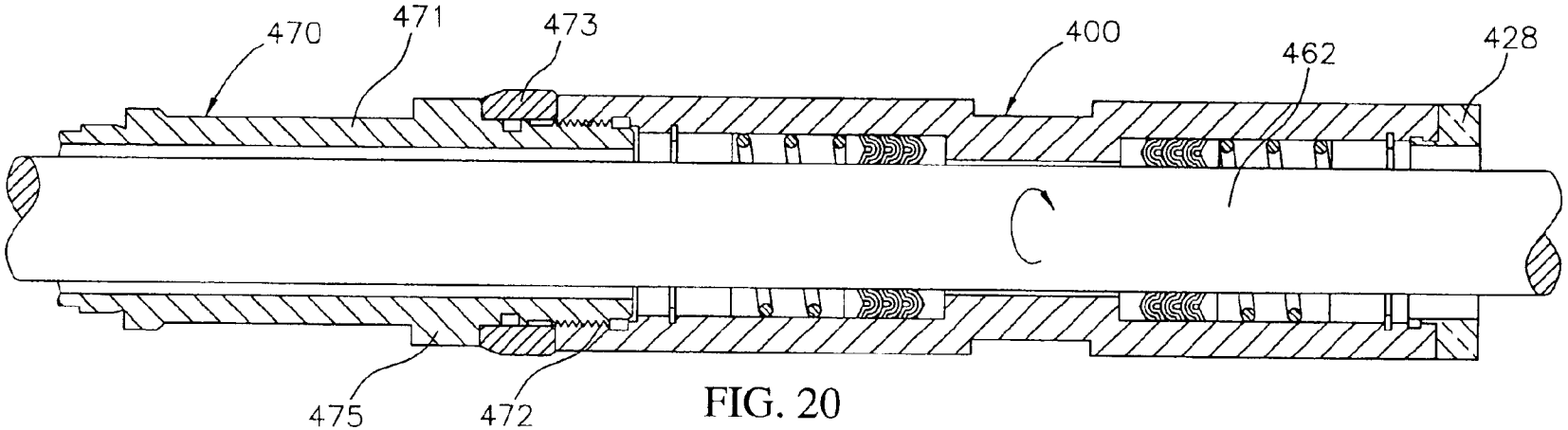
FIG. 20 is a longitudinal, sectional view of the embodiment of the seal cartridge of the present invention illustrated in FIG. 19 as positioned around a rotary rod pump to define the fourth embodiment of the stuffing box assembly of the present invention and as secured to a hold down mandrel.

As positioned around an elongated, rotary rod 480 as illustrated in FIG. 20, seal cartridge 400 forms another embodiment of the downhole stuffing box of the present invention. As illustrated, seal cartridge is connected to a hold down mandrel lock 470. A portion of a hold down mandrel lock 470 is illustrated in FIG. 20 and has a generally cylindrical housing 471 having an annular raised portion in the outer surface thereof which forms a no-go ring 475. The outer surface of one end of housing 471 is provided with any suitable means for attachment to other components, such as screw threads 472. Screw threads 418 on the other end of housing 410 of seal cartridge 400 are mated with screw threads 472. Seal ring 473 is positioned between no-go ring 475 and one end of housing 410 thereby forming a fluid tight seal therebetween.

As thus assembled seal cartridge 400 has one primary positioned on each side of central portion 414 of the inner diameter of housing 400. The annular seals 422 on one side of central portion 414 have an orientation that is exactly opposite or reverse of the orientation of annular seals 422' on the other side of central portion 414. In this manner and as discussed hereinafter, fluid is inhibited from flowing in either direction along an elongated rod that is inserted within housing 410 and in contact with annular seals 422, 422'. Since it is impossible to predict which end of the seal cartridge will be subjected to greater fluid pressure during use and since fluid pressures are constantly changing thereby necessitating that fluid flow be sealed in each axial direction, annular seals 422 and 422' function to seal in both axial directions. This dual acting seal is accomplished in a single seal cartridge.

Figure 21:
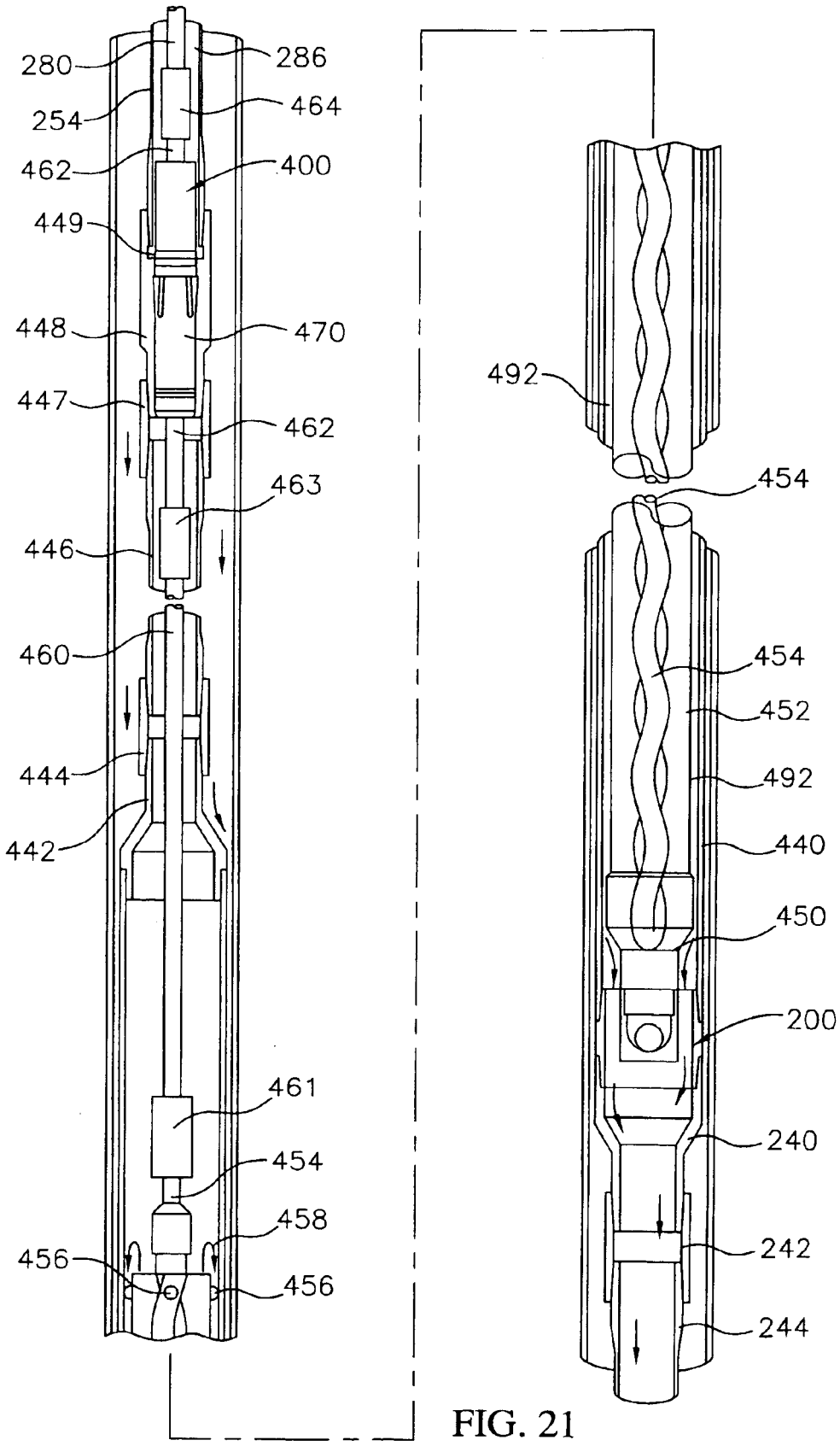
FIG. 21 is a cutaway, partially cross sectioned view of the embodiment of the seal cartridge illustrated in FIGS. 19 and 20 and of the embodiment of the barrel seal manifold illustrated in FIG. 9 as assembled with a rotary pump.

Referring to FIG. 21, the seal cartridge 400 and barrel manifold seal 200 are illustrated as assembled to other component parts, including a rotary pump, for use in accordance with the methods of the present invention. Second end portion 206 of barrel manifold seal is secured to a swedge 240 by means of screw threads 207. Swedge 240 is in turn secured to tubing or tubing sub 244 by any suitable means, such as by a threaded coupling 242. A generally tubular discharge barrel 440 has one end thereof secured to the first end portion 202 of barrel manifold seal 200 by any suitable means, such as by screw threads. The other end of discharge barrel 440 is secured to one end of a tubing cross over 442 by any suitable means, such as by screw threads. A tubing sub 446 is connected to the other end of tubing cross over 442 by any suitable means, such as a threaded connector 444, while the other end of tubing sub 446 is connected to a mechanical top lock seating nipple 448 by any suitable means, such as by a threaded connector 447. Tubing sub 446 may be a single length of tubing or may be made up of several lengths of tubing threaded together in a manner evident to a skilled artisan. The upper other end of seating nipple 448 is secured to tubing string 254 by any suitable means, such as by screw threads. Tubing string 254 may be constructed of joints of tubing that are secured together, for example by screw threads, and extend to a well head (not illustrated) at the surface or the earth or sea floor as will be evident to a skilled artisan. A swedge 450 is sized and configured to be positioned within discharge barrel 440 and has one end thereof secured to bore 210, such as by screw threads mated with screw threads 213 in bore 210 of the barrel manifold seal. A generally tubular stator 452 is positioned within discharge barrel 440 and has one end thereof secured to the other end of swedge 450 by any suitable means, such as by screw threads. A generally annular fluid passageway 492 is defined between stator 452 and discharge barrel 440. Stator 452 may be provided with at least one centralizer 456 to inhibit the stator from contacting the discharge barrel 440 during operation of the pump. Stator 452 is also provided with one or more discharge openings 458 at the upper end thereof. As thus assembled, these component parts defined a housing into which other components of the present invention can be inserted once this housing is positioned at the desired depth in a subterranean well.

The other component parts of this embodiment of the present invention include rotor 454 connected to one end of sucker rod 460 by means of sub coupling 461. The other end of sucker rod 460 is connected to one end of elongated rod 462 by means of sub coupling 463. The other end of elongated rod 462 is connected to sucker rod string 280 by sub coupling 464. Sucker rod string 280 is constructed of individual sucker rods that are secured together by a conventional box and pin arrangement as will be evident to a skilled artisan. Seal assembly 400 and hold down mandrel lock 470 are positioned around elongated rod 462 in a manner as illustrated in FIGS. 20 and 21. The sucker rod string 460 having the rotor 454, seal assembly 400 and hold down mandrel lock 470 secured thereto is lowered from the surface through tubing 254 until rotor 454 is positioned within stator 452. No-go ring 475 on hold down mandrel lock 470 contacts shoulder 449 on the inner surface of seating nipple 448 thereby properly positioning seal assembly 400 and hold down mandrel lock 470 for operation. As thus assembled, fluid discharged by operation of the rotary pump through openings 458 in stator 452 flows through passageway 492, slots 222, 224 of the barrel manifold seal, swedge 240 and tubing 244 in a manner as hereinafter described.

Figure 22:
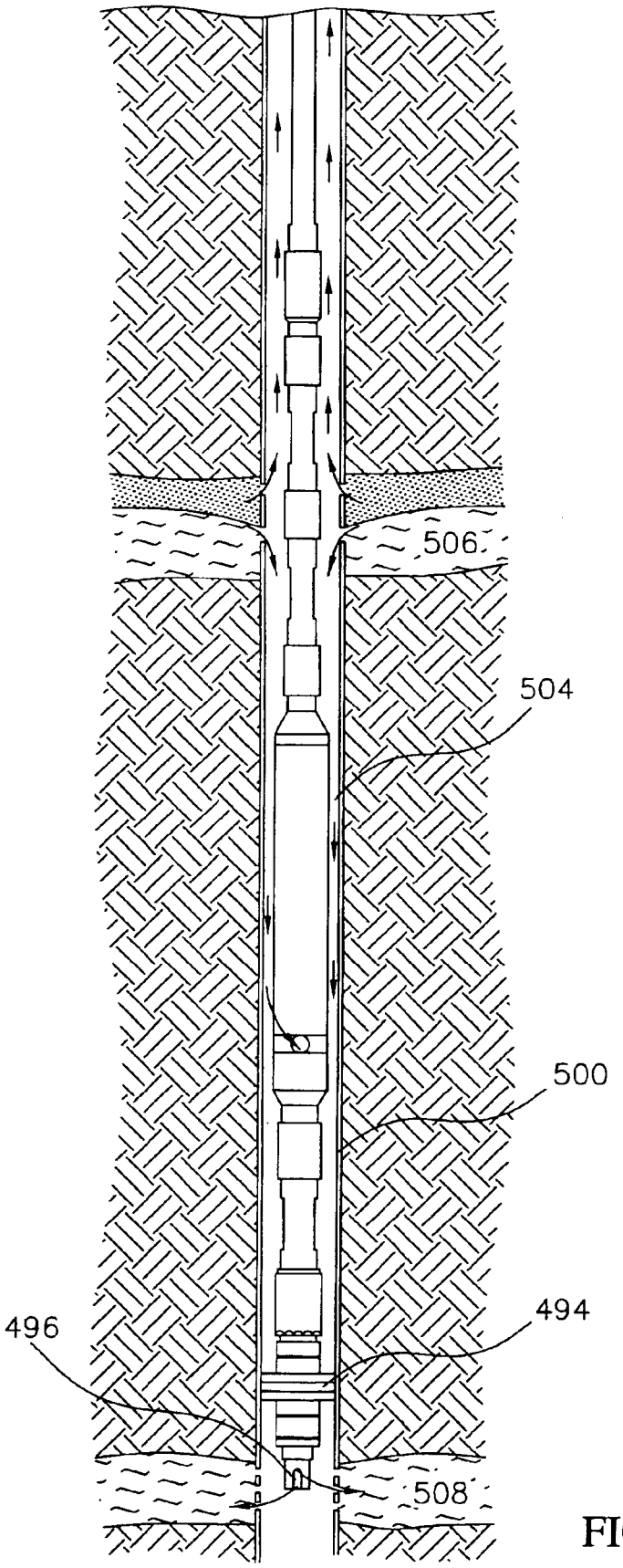
FIG. 22 is partially sectioned view of the assembly of the present illustrated in FIG. 21 as positioned in a subterranean well bore for operation in accordance with the methods of the present invention.

As illustrated in FIG. 22, the assembly of the present invention is positioned in a manner as described above within a subterranean well 500 which penetrates and is in fluid communication with a producing formation or zone 506 and a disposal formation or zone 508. Disposal formation 508 is at a greater depth from the surface of the earth than producing formation 506. Well 500 is illustrated as being provided with casing 501 which is cemented therein in a manner as will be evident to a skilled artisan to prevent flow of fluid between the casing 501 and the walls of well 500. Well 500 can be substantially vertical, deviated or horizontal. The casing is provided with perforations 507 and 509 to provide for fluid communication with formations 506 and 508, respectively. The assembly is provided with an isolation packer 494 which is secured to tubing 244 intermediate the length thereof and a check valve 496 which is secured near the terminal end of tubing 244. The assembly is positioned within well 500 such that check valve 496 is proximate to formation 508. Once positioned, packer 494 is expanded into sealing engagement with casing 501. Alternatively, packer 494 may already be present in an expanded state in casing 501 with a back pressure or check valve 496 attached to and depending therefrom. In this instance, a tubing on/off tool (not illustrated) is utilized to lock the assembly of the present invention to packer 494. Further, well 300 may be an open hole, i.e. totally or partially without casing. For example, packer 494 may be set in casing 501 which terminates above disposal formation 508. Where circumstances permit, such as where subterranean rock is competent and regulatory approval is secured, an appropriate open hole packer may be utilized as packer 294 and set in open hole.

Fluid produced from producing formation 506 enters well 500 via perforations 507 where a reduction in pressure causes gas to separate from liquid and be produced upwardly in annulus 504 formed between casing 500 and the assembly of the present invention and tubing 254 to the surface of the earth for transportation, processing and/or use. Separated fluids, e.g. water, and any other liquid that is produced from formation 506 which may include small quantities of gas, flows downwardly in annulus 504 by gravitational force, is prevented from flowing below expanded packer 494 and flows into ports 216 and 218 of barrel manifold seal 200. The hydrostatic head of produced fluid(s) within annulus 504 causes fluid entering the barrel manifold seal to flow upwardly through bore 210 swedge 450 and enter stator 452 of the progressive cavity pump. Fluid is drawn up through the stator upon rotation of the rotor 454 via sucker rod 460. Fluid is discharged into discharge barrel 440 via openings 458 in the upper end of stator 452. Annular seals 422 in seal cartridge 400 prevent fluid discharged from the stator during rotary pumping from being transported along sucker rod 460 and instead functions to divert the fluid into annulus 492. During continued rotary pumping, fluid is forced through annulus 492, slots 222 and 224 of barrel manifold seal 200, swedge 240, tubing 244 and check valve 496 into disposal formation 508 via perforations 509. Producing formation 506 and disposal formation 508 may be producing intervals, strata, layers or zones of the same formation that are separated by impervious intervals, strata, layers or zones, for example shale, or may be separate and distinct formations. Producing formation 506 and disposal formation 508 can be in relatively close proximity to each other or may be separated by up to thousands of feet.

During operation, fluid, for example fresh water, may be placed within the annulus 286 between tubing 254 and sucker rod string 460, seal cartridge 400, and elongated rod 462 during operation, to prevent rod couplings from rubbing on the tubing, dampen the rods during rotation and to reduce peak torque load on the pump assembly. Further, a corrosion inhibitor may be added to the water to increase the life of the tubing and rotating rods. Annular seals 422' in seal cartridge 400 prevent this fresh, inhibited water from migrating along sucker rod string 280 and rod 462 and commingling with produced fluid in discharge barrel 440. Preferably, annulus 286 is substantially filled with fluid from annular seals 422' to the well head.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A downhole fluid disposal method comprising:

producing fluid from a first subterranean formation into a well that penetrates and is in fluid communication with said first formation, said fluid separating in said well into a first fluid and a second fluid;

pumping said second fluid against a flow barrier in said well by means of a pump having a moveable rod, said barrier inhibiting flow of said pumped second fluid axially along said rod at a point within said well thereby permitting said pumped second fluid to be injected into a second subterranean formation that said well penetrates and is in fluid communication with; and substantially surrounding said rod with fresh water having a scale inhibitor dissolved therein from said point to the surface of the earth, said fresh water inhibited by said barrier from flowing past said point axially along said rod.

2. A method of producing a subterranean well comprising:

producing fluid from a first subterranean formation into the well thereby causing said fluid to separate into a gas and a liquid;

flowing said gas to the surface of the earth; and moving a sucker rod string having one sucker rod actuated pump secured thereto and positioned in the well so as to pump said liquid into a second subterranean formation, said pump having a moveable rod which is secured to said sucker rod string and has a downhole stuffing box positioned around said rod to inhibit flow of said liquid axially along said rod at a point within said well thereby permitting said liquid to be pumped into a second subterranean formation.

3. The method of claim 2 wherein said point is proximate to said pump.

4. The method of claim 3 wherein said point is above said pump.

5. The method of claim 2 wherein said liquid comprises water.

6. The method of claim 2 wherein said gas is produced to the surface of the earth via an annulus defined between casing and tubing that are positioned in said well.

7. The method of claim 2 wherein said first subterranean formation and said second subterranean formation are distinct zones within the same subterranean formation.

8. The method of claim 2 wherein said second formation is deeper than said first formation.

9. The method of claim 2 further comprising:

substantially surrounding said moveable rod and said sucker rod with a second fluid from said point to the surface of the earth, said fluid being inhibited by said barrier from flowing past said point axially along said rod.

10. The method of claim 9 wherein said second fluid is fresh water.

11. The method of claim 2 wherein said well is cased.

12. The method of claim 2 wherein said step of moving said sucker rod string comprises reciprocating said sucker rod string.

13. The method of claim 2 wherein said step of moving said sucker rod string comprises rotating said sucker rod string.

* * * * *